US009624061B2

(12) United States Patent
Matsushita et al.

(10) Patent No.: US 9,624,061 B2
(45) Date of Patent: Apr. 18, 2017

(54) SHEET PROCESSING DEVICE, IMAGE FORMING SYSTEM, AND COMPUTER-READABLE STORAGE MEDIUM

(71) Applicants: Shingo Matsushita, Tokyo (JP); Keisuke Sugiyama, Kanagawa (JP); Kiyoshi Hata, Tokyo (JP); Takashi Saito, Kanagawa (JP); Akihiro Musha, Kanagawa (JP); Ikuhisa Okamoto, Kanagawa (JP); Takehisa Shimazu, Kanagawa (JP); Takeshi Akai, Kanagawa (JP); Kyosuke Nakada, Kanagawa (JP); Jun Yamada, Kanagawa (JP); Joh Ebara, Kanagawa (JP); Takaya Ochiai, Kanagawa (JP); Takuya Sano, Kanagawa (JP); Masatada Satoh, Kanagawa (JP)

(72) Inventors: Shingo Matsushita, Tokyo (JP); Keisuke Sugiyama, Kanagawa (JP); Kiyoshi Hata, Tokyo (JP); Takashi Saito, Kanagawa (JP); Akihiro Musha, Kanagawa (JP); Ikuhisa Okamoto, Kanagawa (JP); Takehisa Shimazu, Kanagawa (JP); Takeshi Akai, Kanagawa (JP); Kyosuke Nakada, Kanagawa (JP); Jun Yamada, Kanagawa (JP); Joh Ebara, Kanagawa (JP); Takaya Ochiai, Kanagawa (JP); Takuya Sano, Kanagawa (JP); Masatada Satoh, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 15/011,891

(22) Filed: Feb. 1, 2016

(65) Prior Publication Data

US 2016/0221787 A1 Aug. 4, 2016

(30) Foreign Application Priority Data

Feb. 2, 2015 (JP) ..... 2015-018679
Mar. 10, 2015 (JP) ..... 2015-047310
Jun. 17, 2015 (JP) ..... 2015-122146

(51) Int. Cl.
*B65H 31/00* (2006.01)
*B65H 37/04* (2006.01)
(Continued)

(52) U.S. Cl.
CPC ..... *B65H 37/04* (2013.01); *B65H 31/02* (2013.01); *B65H 31/10* (2013.01);
(Continued)

(58) Field of Classification Search
CPC ..... B65H 2515/50; B65H 2601/125; B65H 2601/524
See application file for complete search history.

(56) References Cited

U.S. PATENT DOCUMENTS

2009/0183646 A1* 7/2009 Baureis ..... B41F 13/008 101/408
2012/0146279 A1 6/2012 Furuhashi et al.
2013/0270763 A1 10/2013 Furuhashi et al.

FOREIGN PATENT DOCUMENTS

FI WO 2010018305 A1 * 2/2010 ..... B65H 23/195
JP 11-301918 11/1999
(Continued)

OTHER PUBLICATIONS

English translation of JP-2011131414.*

*Primary Examiner* — Howard Sanders
(74) *Attorney, Agent, or Firm* — Harness, Dickey & Pierce, P.L.C.

(57) ABSTRACT

A sheet processing device includes a sheet processing unit that is moved to perform sheet processing on a sheet; a
(Continued)

sheet-processing moving unit that moves the sheet processing unit; a drive-mode determining unit that determines a drive mode of the sheet-processing moving unit; and a drive control unit that drives the sheet-processing moving unit in accordance with the drive mode. The drive-mode determining unit determines the drive mode such that the sheet processing unit is moved at combination acceleration that is a combination of first acceleration and second acceleration with a shift of time that is determined based on the cycle of the natural vibration that occurs during acceleration of the sheet processing unit.

14 Claims, 38 Drawing Sheets

(51) Int. Cl.

| | |
|---|---|
| ***B65H 31/02*** | (2006.01) |
| ***B65H 31/10*** | (2006.01) |
| ***B65H 31/30*** | (2006.01) |
| ***B65H 31/36*** | (2006.01) |
| ***B65H 31/38*** | (2006.01) |
| ***B65H 33/08*** | (2006.01) |
| ***B65H 43/00*** | (2006.01) |

(52) U.S. Cl.

CPC ..... *B65H 31/3081* (2013.01); *B65H 31/36* (2013.01); *B65H 31/38* (2013.01); *B65H 33/08* (2013.01); *B65H 43/00* (2013.01); *B65H 2301/4212* (2013.01); *B65H 2301/4213* (2013.01); *B65H 2405/11151* (2013.01); *B65H 2405/351* (2013.01); *B65H 2511/13* (2013.01); *B65H 2511/30* (2013.01); *B65H 2513/40* (2013.01); *B65H 2515/112* (2013.01); *B65H 2515/50* (2013.01); *B65H 2557/242* (2013.01); *B65H 2601/521* (2013.01); *B65H 2601/524* (2013.01); *B65H 2801/27* (2013.01)

(56) References Cited

FOREIGN PATENT DOCUMENTS

| | | | |
|---|---|---|---|
| JP | 2004-357374 | | 12/2004 |
| JP | 2007-276962 | | 10/2007 |
| JP | 2011131414 A | * | 7/2011 |
| JP | 5126211 | | 11/2012 |
| JP | 2013-063831 | | 4/2013 |
| JP | 2013-063832 | | 4/2013 |

* cited by examiner

SHEET PROCESSING DEVICE, IMAGE FORMING SYSTEM, AND COMPUTER-READABLE STORAGE MEDIUM

CROSS-REFERENCE TO RELATED APPLICATIONS

The present application claims priority to and incorporates by reference the entire contents of Japanese Patent Application No. 2015-018679 filed in Japan on Feb. 2, 2015; Japanese Patent Application No. 2015-047310 filed in Japan on Mar. 10, 2015; and Japanese Patent Application No. 2015-122146 filed in Japan on Jun. 17, 2015.

BACKGROUND OF THE INVENTION

1. Field of the Invention

The present invention relates to a sheet processing device, an image forming system, and a control program for a sheet processing device.

2. Description of the Related Art

In recent years, there have been known sheet processing devices that include a sheet processing mechanism (hereafter, referred to as the "stitching processing unit") that stitches the stacked bundle of sheets. To stitch a bundle of sheets, the above sheet processing device moves the stitching processing unit to the target position and stitches the bundle of sheets at that position. However, in this type of sheet processing device, the natural vibration occurs when the stitching processing unit is moved.

Therefore, this type of sheet processing device has a problem in that noise occurs due to the movement of the stitching processing unit. Furthermore, in this sheet processing device, if sheet processing is conducted while vibrations occur due to the movement of the stitching processing unit, the sheet processing accuracy is degraded; therefore, there is a need to delay the start of processing on the subsequent sheet until the vibrations disappear, and there is a problem of a decrease in the productivity. Moreover, the above sheet processing device may have various problems due to the natural vibration that occurs when the stitching processing unit is moved.

Therefore, among the above-described sheet processing devices, a sheet processing device has been disclosed and already known, which controls the acceleration of the stitching processing unit so as to perform vibration control to prevent the natural vibration (for example, see Japanese Laid-open Patent Publication No. 2013-063831).

However, conventional sheet processing devices prevent the vibration by controlling the acceleration when the stitching processing unit is moved; therefore, the time during which the stitching processing unit is moved becomes accordingly longer, and the productivity is decreased. Therefore, if the sheet processing device does not control the acceleration of the stitching processing unit, the productivity may be improved; however, the vibration is increased due to the movement of the stitching processing unit.

As described above, with the conventional sheet processing devices, improvement in the productivity and prevention of the vibration have a trade-off relation, and there is a problem such that, if either one of them is given with priority, the other one is sacrificed.

Furthermore, this problem may also occur in a sheet processing device, which includes a punching unit that punches a sheet, when the punching unit is moved.

Furthermore, the above problem may also occur in a sheet processing device, which moves a sheet stack unit to adjust the level of a bundle of sheets and the level of a sheet conveyance path or to adjust the stack position of a bundle of sheets, when the sheet stack unit is moved.

Furthermore, the above problem may also occur in a sheet processing device, which moves a sheet ejecting unit while it is in contact with a bundle of sheets to eject a sheet, stacked on the sheet stack unit, when the sheet ejecting unit is moved.

Moreover, the above problem may also occur in a sheet processing device, which moves a pair of sheet aligning units such that they are opposed to each other with a bundle of sheets interposed therebetween in a sheet width direction so as to align the bundle of sheets, when the sheet aligning units are moved.

Therefore, there is a need to prevent the vibration that occurs when a sheet processing unit is moved.

SUMMARY OF THE INVENTION

It is an object of the present invention to at least partially solve the problems in the conventional technology.

According to an embodiment, there is provided a sheet processing device that includes a sheet processing unit that is moved to perform sheet processing on a sheet; a sheet-processing moving unit that moves the sheet processing unit; a drive-mode determining unit that determines a drive mode of the sheet-processing moving unit; and a drive control unit that drives the sheet-processing moving unit in accordance with the drive mode. The drive-mode determining unit determines the drive mode such that the sheet processing unit is moved at combination acceleration that is a combination of first acceleration and second acceleration with a shift of time that is determined based on a cycle of natural vibration that occurs during acceleration of the sheet processing unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

First Embodiment

Figure 1:
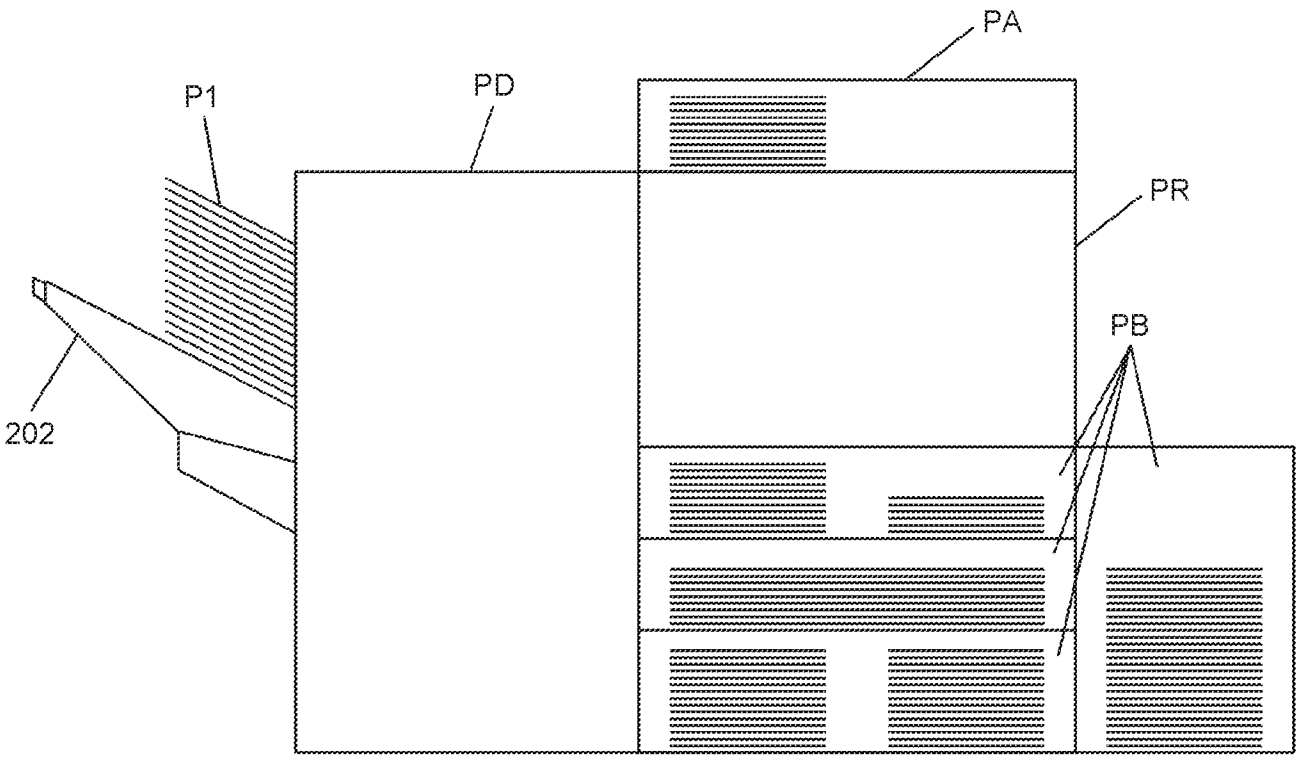
FIG. 1 is a diagram that illustrates an example of the operation form of an image forming system according to an embodiment.

With reference to the drawings, a detailed explanation is given below of an embodiment of the present invention. First, an explanation is given, with reference to FIG. 1, of an operation form of an image forming system according to the present embodiment. FIG. 1 is a diagram that illustrates an example of the operation form of the image forming system according to the present embodiment.

As illustrated in FIG. 1, the image forming system according to the present embodiment includes an image forming device PR, a document reading device PA, a post-processing device PD, and a sheet feeding device PB. Furthermore, the image forming device PR, the document reading device PA, the post-processing device PD, and the sheet feeding device PB are connected via a communication port, and a communication is performed via the communication port.

The image forming device PR is a multifunction peripheral (MFP) that has an image capturing function, an image forming function, a communication function, or the like, so that it may be used as a printer, facsimile machine, scanner, or copier. The specific form of an image forming mechanism of the image forming device PR according to the present embodiment includes an electrophotographic system or an ink jet system.

The post-processing device PD is a post-processing mechanism that performs post-processing, such as a stitching operation, folding operation, or bookbinding operation, on sheets, on which an image has been formed by the image forming device PR. After a sheet bundle P1 is ejected from the post-processing device PD, it is sequentially stacked on a shift tray 202. That is, according to the present embodiment, the post-processing device PD serves as a sheet processing device. Furthermore, various types of parameters, necessary for control, such as operation information, sheet information, or sheet feeding information, are transmitted from the image forming device PR to the post-processing device PD via the above-described communication port.

The document reading device PA includes an automatic document feeder that automatically feeds a document, which is the target to be read, and it reads a document that is automatically fed from the automatic document feeder. The sheet feeding device PB feeds a sheet to the image forming device PR. Furthermore, in some of the sheet feeding devices PB, the chassis is shared with the image forming device PR, or otherwise the chassis is separated from the image forming device PR.

Figure 2:
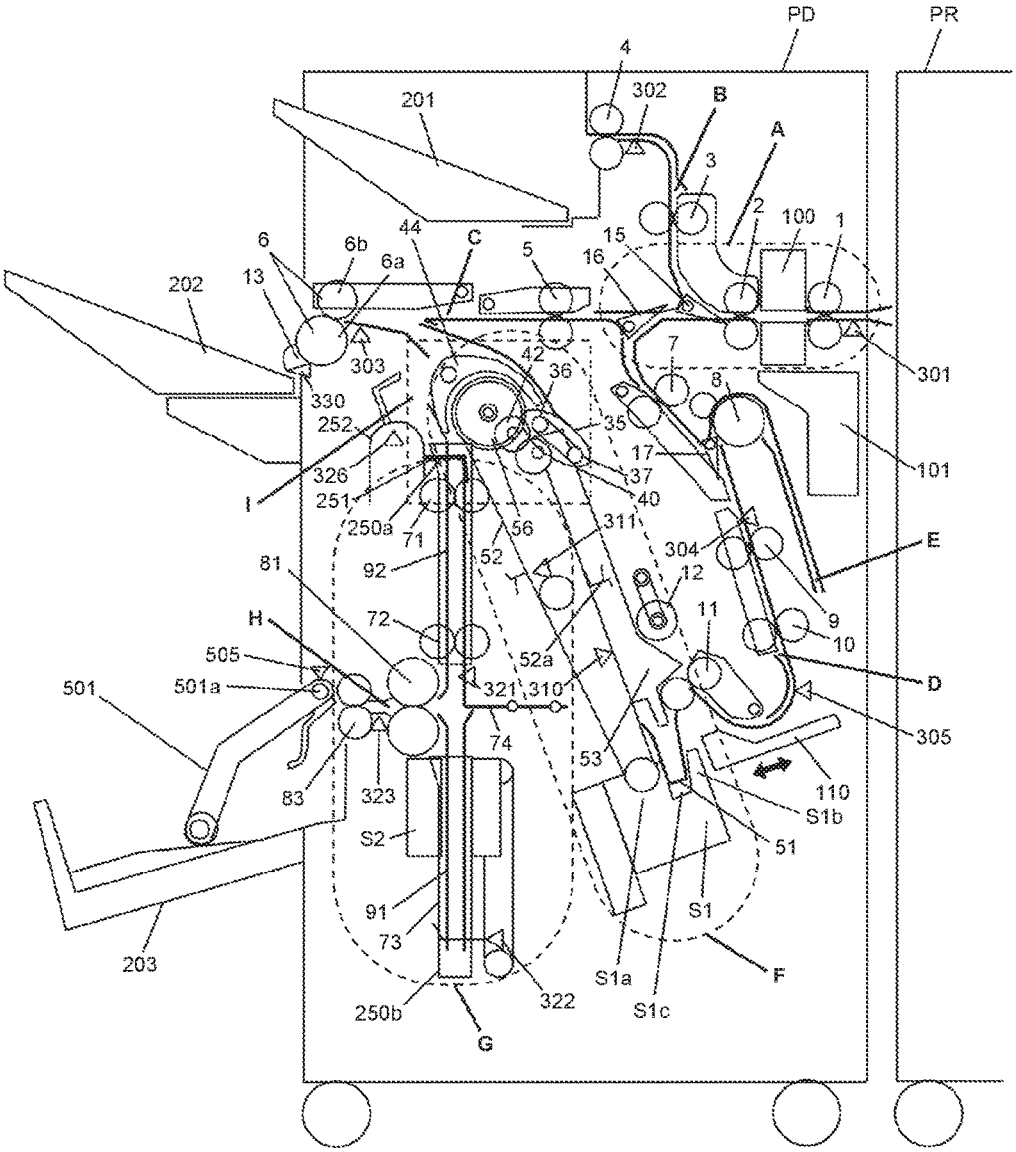
FIG. 2 is a cross-sectional view that illustrates a post-processing device according to the embodiment in a main scanning direction.

Next, with reference to FIG. 2, an explanation is given of the configuration of the post-processing device PD according to the present embodiment. FIG. 2 is a cross-sectional view that illustrates the post-processing device PD according to the present embodiment in the main scanning direction.

The post-processing device PD according to the present embodiment is attached to the side portion of the image forming device PR. Furthermore, after a sheet is ejected from the image forming device PR, it is guided to the post-processing device PD.

The post-processing device PD includes a conveyance path A, a conveyance path B, a conveyance path C, a conveyance path D, and a conveyance path H. Furthermore, in the post-processing device PD, a sheet, ejected from the image forming device PR, is first conveyed to the conveyance path A that includes a post-processing unit that performs post-processing on sheets. The post-processing unit is a punch unit 100.

The conveyance path B is a conveyance path that leads to an upper tray 201 through the conveyance path A, and the conveyance path C is the conveyance path C that leads to the shift tray 202. The conveyance path D is the conveyance path D that leads to a processing tray F (hereafter, also referred to as the "end-face stitching processing tray F") that performs alignment, staple stitching, or the like. The configuration is such that separation is made from the conveyance path A to the conveyance path B, C, or D by a bifurcating claw 15 and a bifurcating claw 16.

The post-processing device PD according to the present embodiment includes the punch unit 100, a jogger fence 53, an end-face stitching stapler S1, a saddle-stitching upper jogger fence 250*a*, a saddle-stitching lower jogger fence 250*b*, a saddle-stitching stapler S2, the shift tray 202, a folding plate 74, and a folding roller 81.

The punch unit 100 conducts punching on a sheet. The jogger fence 53 and the end-face stitching stapler S1 conduct sheet alignment and end-face stitching. The saddle-stitching lower jogger fence 250*b* and the saddle-stitching stapler S2 conduct sheet alignment and saddle stitching. The shift tray 202 conducts sorting on sheets. The folding plate 74 and the folding roller 81 perform center-folding.

Therefore, the post-processing device PD selects the conveyance path A and the following conveyance paths B, C, and D in accordance with the operation conducted. The conveyance path D includes a sheet housing section E. On the downstream side of the conveyance path D are provided the end-face stitching processing tray F, a saddle-stitching/center-folding processing tray G, and the paper-ejection conveyance path H.

On the conveyance path A that is located upstream of the conveyance path B, the conveyance path C, and the conveyance path D and that is common to each of them, an entry sensor 301 is located to detect a sheet, which is received from the image forming device PR, and an entry roller 1, the punch unit 100, a punch waste hopper 101, a conveying roller 2, the first bifurcating claw 15, and the second bifurcating claw 16 are sequentially located downstream thereof.

The first and second bifurcating claws 15, 16 are kept in the initial state illustrated in FIG. 2 by a spring, and they are driven when first and second solenoids are turned on. When the first and second solenoids are turned on/off, the combination of bifurcating directions of the first and second bifurcating claws 15, 16 is changed so that the sheet is delivered to the conveyance path B, the conveyance path C, or the conveyance path D.

If the sheet is to be guided to the conveyance path B, the post-processing device PD keeps the state illustrated in FIG. 2, i.e., the state where the first solenoid is off (the first bifurcating claw 15 faces downward in the initial state). Thus, the sheet is delivered from a conveying roller 3 to a paper ejection roller 4 and is discharged onto the upper tray 201.

If the sheet is to be guided to the conveyance path C, the post-processing device PD changes the state that is illustrated in FIG. 2 into the state where the first and second solenoids are on (the second bifurcating claw 16 faces upward in the initial state) so that a state is obtained such that the bifurcating claw 15 rotates upward and the bifurcating claw 16 rotates downward. Thus, the sheet is conveyed toward the shift tray 202 through a conveying roller 5 and a pair of paper ejection rollers 6 (6*a*, 6*b*). In this case, sheet sorting is conducted.

Sheet sorting is performed by a shift-tray paper ejection unit that is located on the lowest downstream section of the post-processing device PD. Sheet sorting is performed by the pair of paper ejection rollers 6*a*, 6*b*; a return roller 13; a sheet-surface detection sensor 330; the shift tray 202; a shift mechanism; and a shift-tray lifting/lowering mechanism. The shift mechanism moves the shift tray 202 back and forth in a direction perpendicular to the sheet conveying direction. The shift-tray lifting/lowering mechanism lifts and lowers the shift tray 202.

If the sheet is to be guided to the conveyance path D, the post-processing device PD turns on the first solenoid that drives the first bifurcating claw 15 and turns off the second solenoid that drives the second bifurcating claw so that a state is obtained such that the bifurcating claw 15 rotates upward and the bifurcating claw 16 rotates downward. Thus, the sheet is guided from the conveying roller 2 toward the conveyance path D via a conveying roller 7.

After being guided to the conveyance path D, the sheet is guided to the end-face stitching processing tray F. After being subjected to alignment, stapling, or the like, on the end-face stitching processing tray F, the sheet is delivered by a guide member 44 to the conveyance path C that leads to the shift tray 202 or the saddle-stitching/center-folding processing tray G (hereafter, also simply referred to as the "saddle-stitching processing tray") that performs folding, or the like.

If the sheet is to be guided to the shift tray 202 after being guided to the conveyance path D, it is ejected onto the shift tray 202 through the pair of paper ejection rollers 6. Furthermore, if the sheet is guided to the saddle-stitching processing tray G after being guided to the conveyance path D, it is subjected to folding and stitching on the saddle-stitching processing tray G and then ejected onto a lower tray 203 through a paper ejection roller 83 via the paper ejection conveyance path H.

Furthermore, a bifurcating claw 17 is provided on the conveyance path D and is kept in the state that is illustrated in FIG. 2 by a low-load spring. After the trailing edge of the sheet, conveyed by the conveying roller 7, passes through the bifurcating claw 17, the post-processing device PD rotates at least any one of conveying rollers 9, 10 and a staple paper ejection roller 11 in reverse so that the sheet may be moved backward along a turn guide 8.

Thus, in the post-processing device PD, the sheet is guided to the sheet housing section E, starting from the trailing edge thereof, and is held (pre-stacked) so that it may be conveyed with a subsequent sheet overlapped thereon. The post-processing device PD repeats this operation, whereby two or more sheets may be overlapped on one another while being conveyed. Moreover, a pre-stack sensor 304 is a sensor for setting a backward feed timing when a sheet is to be pre-stacked.

In the post-processing device PD, when the sheet is guided to the conveyance path D and is subjected to sheet alignment and end-stitching, the sheet is guided to the end-face stitching processing tray F by the staple paper ejection roller 11 and is sequentially stacked on the end-face stitching processing tray F.

In this case, in the post-processing device PD, each sheet is aligned by a tapping roller 12 in the vertical direction (the sheet conveying direction) and in the sheet thickness direction and is aligned by the jogger fence 53 in the traverse direction (hereafter, also referred to as "the direction perpendicular to the sheet conveying direction" or "the sheet width direction").

In the post-processing device PD, the end-face stitching stapler S1, which is a stitching unit, is driven in accordance with a staple signal from a control device during the interval between jobs, i.e., during the interval between the final sheet in the sheet bundle and the leading sheet in the subsequent sheet bundle, whereby a stitching operation is performed. After the stitching operation is performed, the sheet bundle is immediately delivered to the pair of paper ejection rollers 6 by a release belt 52, from which a release claw 52*a* protrudes, and is ejected onto the shift tray 202 that is set in the receiving position.

Furthermore, as illustrated in FIG. 2, the end-face stitching stapler S1 includes a stitcher S1*a* that inserts a staple; and a clincher S1*b* that bends the end of the staple. The space between the stitcher (driver) S1*a* and the clincher S1*b* is a space S1*c*, through which a trailing-edge reference fence S1 may pass. Therefore, the end-face stitching stapler S1 is movable without any interference between the end-face stitching stapler S1 and the trailing-edge reference fence 51.

Furthermore, the end-face stitching stapler S1 is different from the saddle-stitching stapler S2 in that the stitcher S1*a* and the clincher S1*b* are integrally formed. The stitcher S1*a* is a fixed side that does not move in a vertical direction with respect to the sheet surface, and the clincher S1*b* is a movable side that moves in a vertical direction with respect to the sheet surface.

When the end-face stitching stapler S1, configured as above, performs a stitching operation on the sheet bundle, the clincher S1*b* moves toward the stitcher S1*a* at a predetermined stitching area of the sheet bundle that is stacked on the trailing-edge reference fence 51, whereby the sheet bundle is stitched. That is, according to the present embodiment, the end-face stitching stapler S1 serves as a sheet processing unit.

As described later with reference to FIGS. 3 and 4, the release belt 52 is located in the alignment center with respect to the sheet width direction, is extended between pulleys 62, and is driven by a release-belt drive motor 157. Furthermore, as described later with reference to FIGS. 3 and 4, multiple release rollers 56 are arranged symmetrically with respect to the release belt 52 on the sheet ejection side of the end-face stitching processing tray F, and they are rotatably attached to the drive shaft so as to function as driven rollers.

The home position of the release claw 52*a* is detected by a release-belt HP sensor 311. The release-belt HP sensor 311 is turned on/off by the release claw 52*a* that is provided on the release belt 52. The two release claws 52*a* are provided at opposite positions on the outer circumference of the release belt 52.

The two release claws 52*a* alternately move and convey the sheet bundle, which is housed in the end-face stitching processing tray F. Furthermore, the post-processing device PD rotates the release belt 52 in the opposite direction if needed, whereby it is possible to align the leading edge of the sheet bundle, housed in the end-face stitching processing tray F, in the conveying direction on the back side of the release claw 52*a*.

Furthermore, a trailing-edge pressing lever 110 is located on the lower end of the trailing-edge reference fence 51 so as to press the trailing edge of the sheet bundle, housed in the trailing-edge reference fence 51, from the sheet surface, and it moves back and forth in substantially a vertical direction with respect to the end-face stitching processing tray F. After being ejected onto the end-face stitching processing tray F, each sheet is aligned by the tapping roller 12 in the vertical direction (the sheet conveying direction).

However, if the trailing edge of the sheet, stacked on the end-face stitching processing tray F, is curled or if the rigidity of the sheet is low, the trailing edge of the sheet tends to bend and curl due to its own weight. Moreover, if the number of sheets stacked is increased, the space for receiving the subsequent sheet within the trailing-edge reference fence 51 becomes small; therefore, alignment in a vertical direction tends to be poor. Thus, a trailing-edge pressing mechanism is provided to make the trailing edge of the sheet less curled and to make the sheet easily enter the trailing-edge reference fence 51, and the trailing-edge pressing lever 110 directly presses the sheet.

Each of sheet detection sensors 302, 303, 304, 305, and 310 is a sensor that detects the presence or absence of a sheet that is passed through the installed position or the presence or absence of a sheet stacked.

Figure 3:
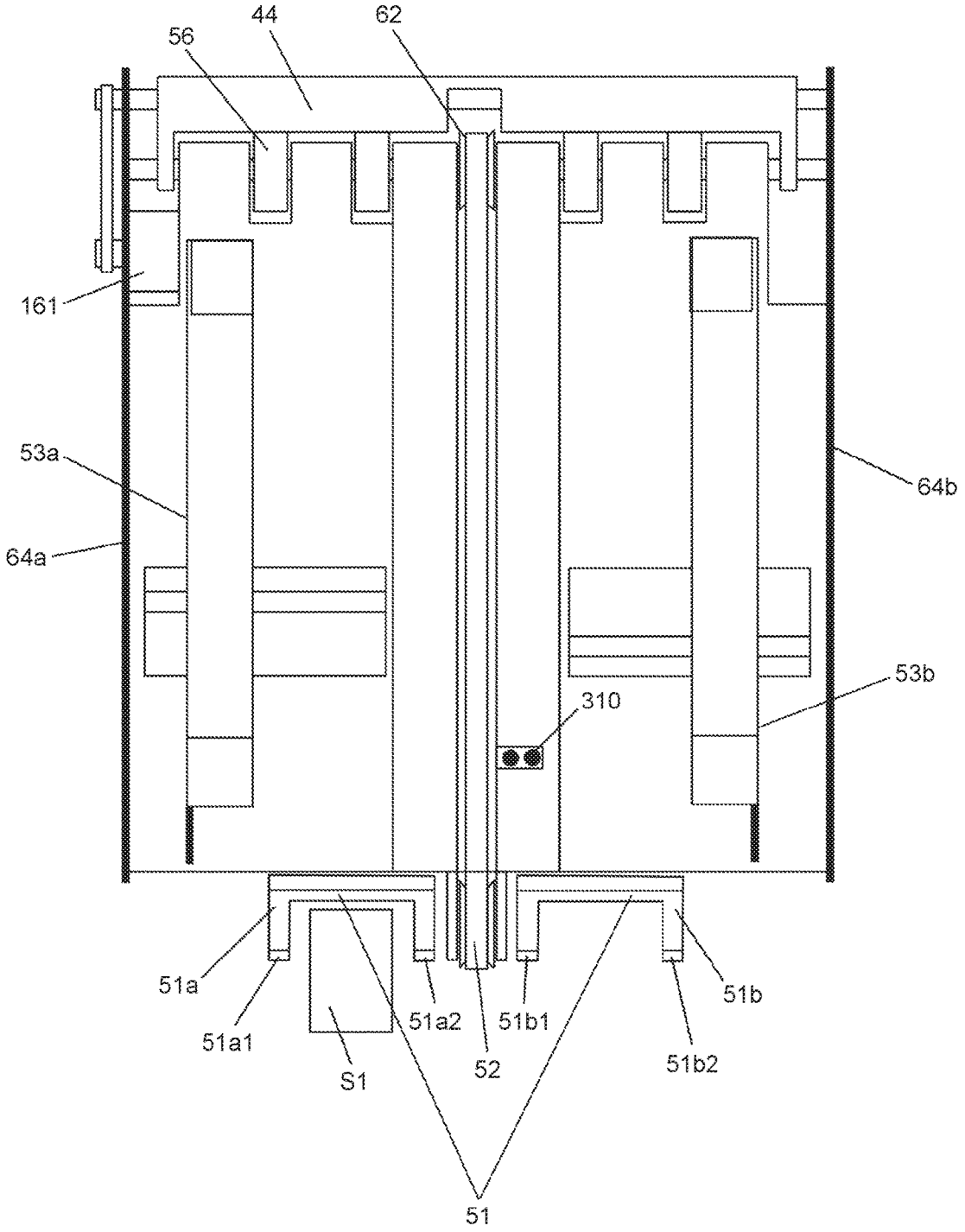
FIG. 3 is a front view of an end-face stitching processing tray according to the embodiment when viewed from a sheet stack surface.
Figure 4:
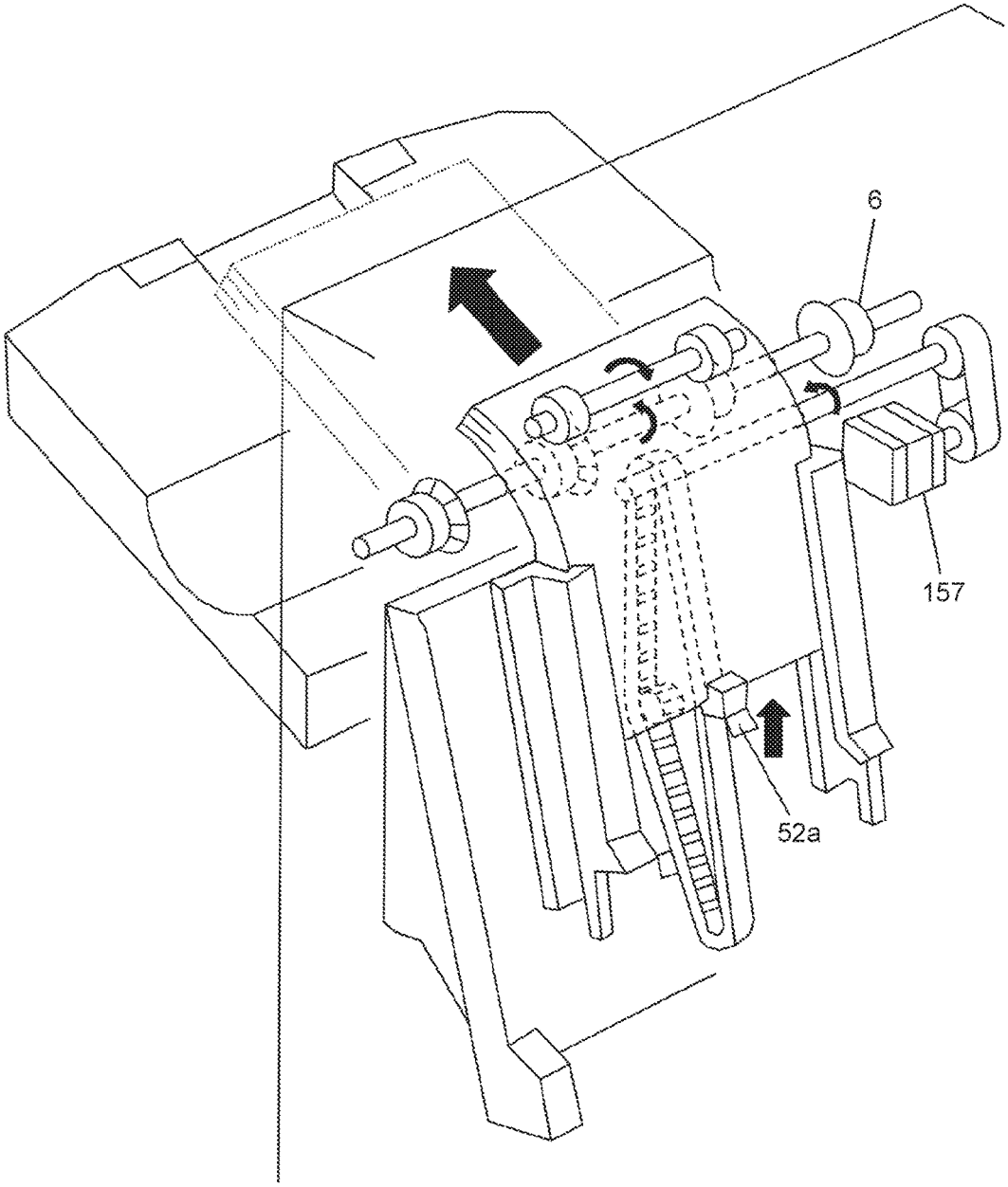
FIG. 4 is a perspective view of the end-face stitching processing tray according to the embodiment when viewed from the sheet stack surface.
Figure 5:
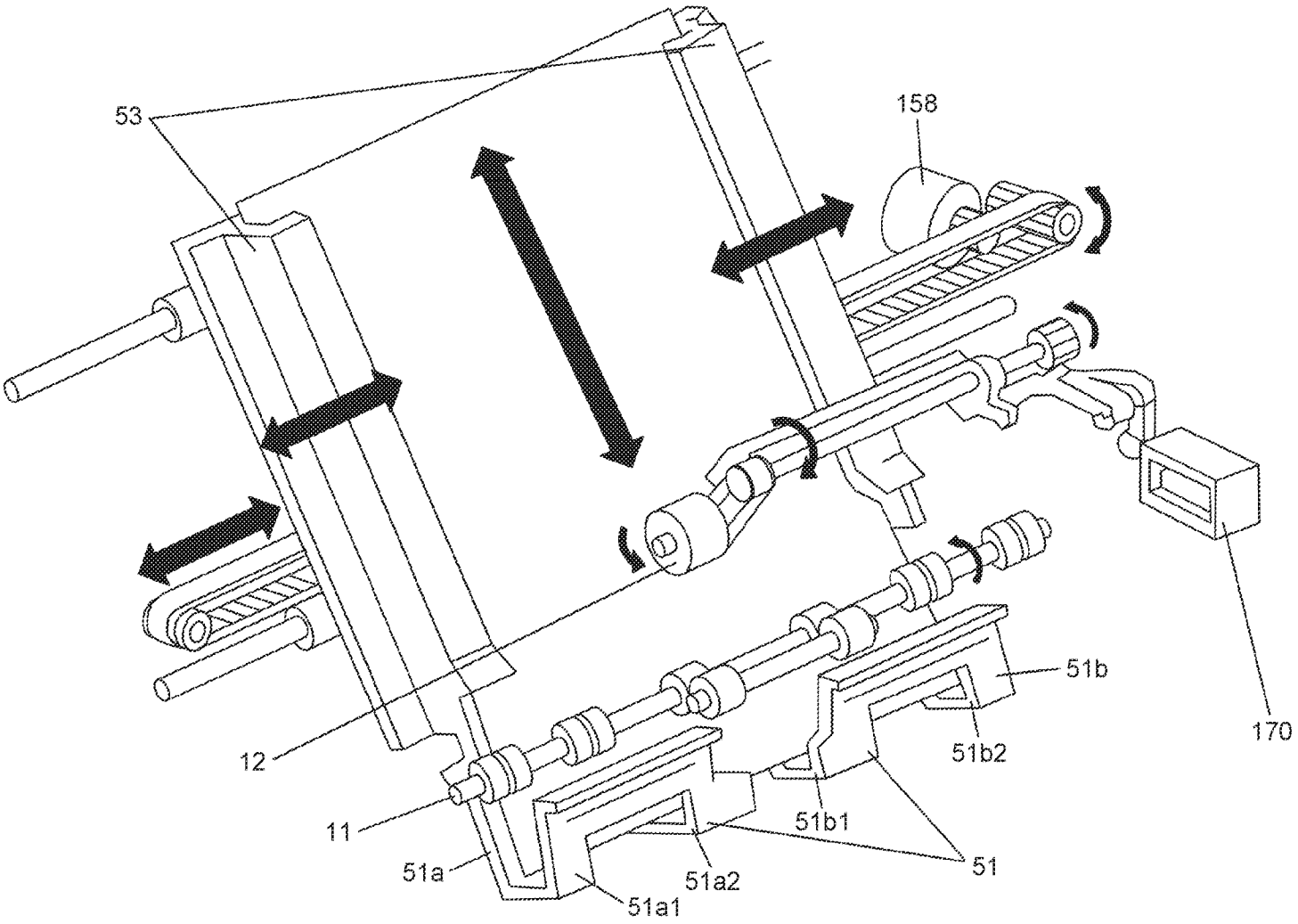
FIG. 5 is a perspective view of the end-face stitching processing tray according to the embodiment when viewed from the sheet stack surface.
Figure 6:
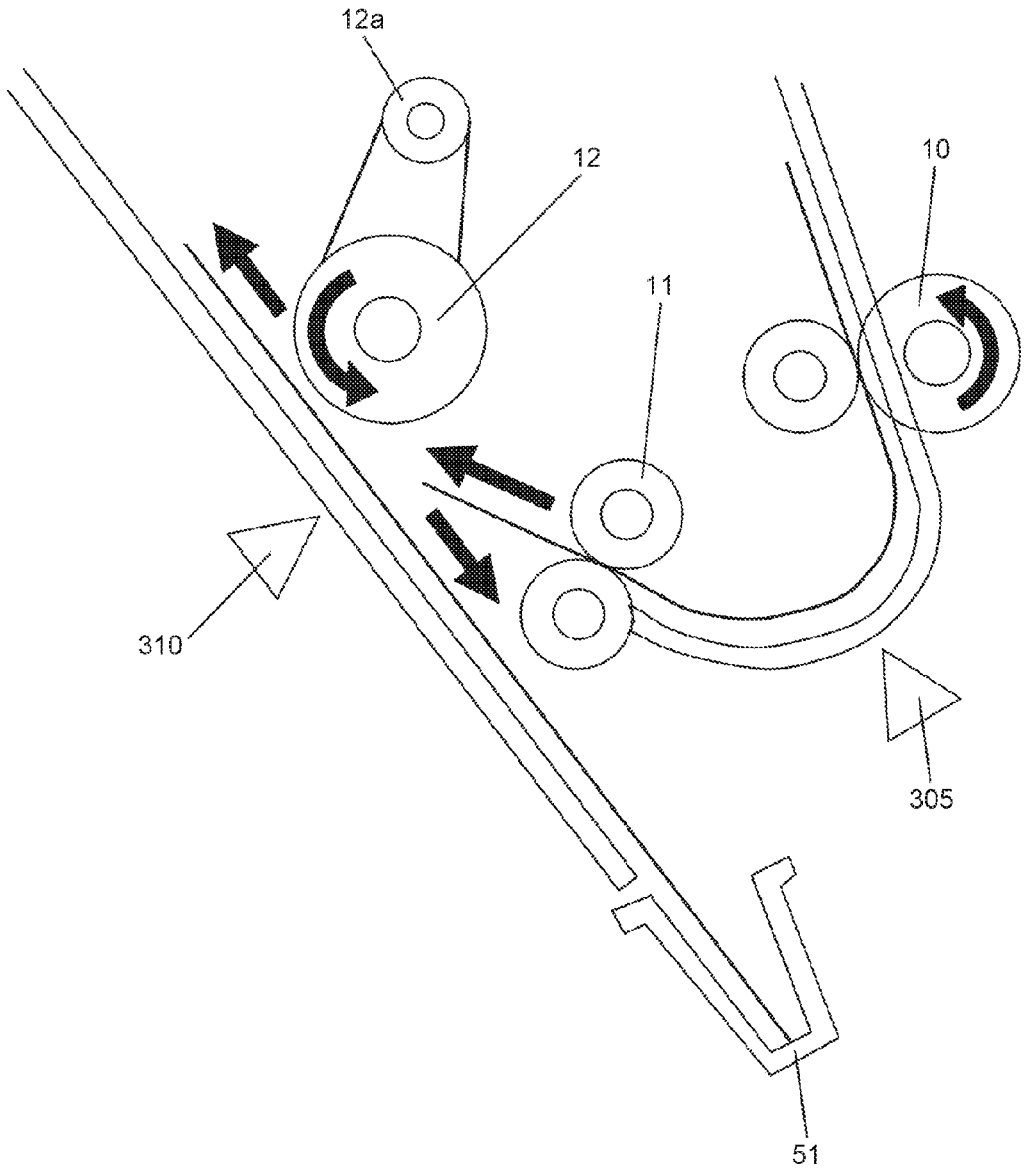
FIG. 6 is a cross-sectional view of the end-face stitching processing tray according to the embodiment when viewed in a main scanning direction.

Next, with reference to FIGS. 3 to 6, an explanation is given of the configuration of the end-face stitching processing tray F according to the present embodiment. FIG. 3 is a front view of the end-face stitching processing tray F according to the present embodiment when viewed from the sheet stack surface. FIGS. 4 and 5 are perspective views of the end-face stitching processing tray F according to the present embodiment when viewed from the sheet stack surface. FIG. 6 is a cross-sectional view of the end-face stitching processing tray F according to the present embodiment when viewed in the main scanning direction.

The sheet, received from the image forming device PR on the upstream side, is aligned in the width direction by jogger fences 53*a* and 53*b* and is aligned in the sheet conveying direction when it comes into contact with first and second trailing-edge reference fences 51*a*, 51*b*.

The first and second trailing-edge reference fences 51*a*, 51*b* include stack surfaces 51*a*1, 51*a*2, and 51*b*1, 51*b*2, respectively, on inner surfaces thereof, which are in contact with the sheet trailing edge to support the sheet bundle, whereby the sheet trailing edge is supported. As can be seen from FIG. 3, it may be supported at four points.

Thus, the sheet bundle is stacked and is in contact with any two points on the stack surfaces 51*a*1, 51*a*2, 51*b*1, and 51*b*2 of the trailing-edge reference fence 51. This is because of considerations on mechanical errors including the assembly accuracy of the trailing-edge reference fences 51*a*, 51*b* and, as the sheet bundle is supported at two points, it may be held in a more stable state.

Furthermore, in the case of one-point diagonal stitching, the end-face stitching stapler S1 moves to the end of the stacked sheet bundle and performs a stitching operation on the sheet bundle in a tilted state.

In the post-processing device PD, after the alignment operation is completed, the end-face stitching stapler S1 performs a stitching operation and, as can be seen in FIG. 4, the release belt 52 is driven by the release-belt drive motor 157 in a counterclockwise direction.

Furthermore, in the post-processing device PD, the sheet bundle, on which the stitching operation has been performed, is picked up by the release claw 52*a*, attached to the release belt 52, and is released from the end-face stitching processing tray F. Side plates 64*a*, 64*b* are side plates that support the end-face stitching processing tray F.

Furthermore, in the post-processing device PD, the same operation as that described above may be performed on an unstitched bundle, on which the stitching operation is not performed after the alignment operation.

As illustrated in FIGS. 5 and 6, after being guided to the end-face stitching processing tray F by the staple paper ejection roller 11, the sheet is sequentially stacked on the end-face stitching processing tray F. At that time, if the number of sheets to be ejected onto the end-face stitching processing tray F is one, each sheet is aligned in the vertical direction (the sheet conveying direction) by the tapping roller 12 and is aligned in the width direction (the sheet width direction perpendicular to the sheet conveying direction) by the jogger fences 53*a* and 53*b*.

A tapping solenoid 170 applies a pendulum movement to the tapping roller 12 around a supporting point 12*a*, whereby it intermittently acts on the sheet delivered to the end-face stitching processing tray F so that the sheet trailing edge comes into contact with the trailing-edge reference fence 51. Furthermore, the tapping roller 12 rotates in a counterclockwise direction.

As illustrated in FIGS. 3 and 5, the pairs of jogger fences 53 (53*a*, 53*b*) is provided in the sheet width direction, is driven via a timing belt by a jogger motor 158 that is rotatable in the normal and opposite directions, and is moved back and forth in the sheet width direction.

Figure 7:
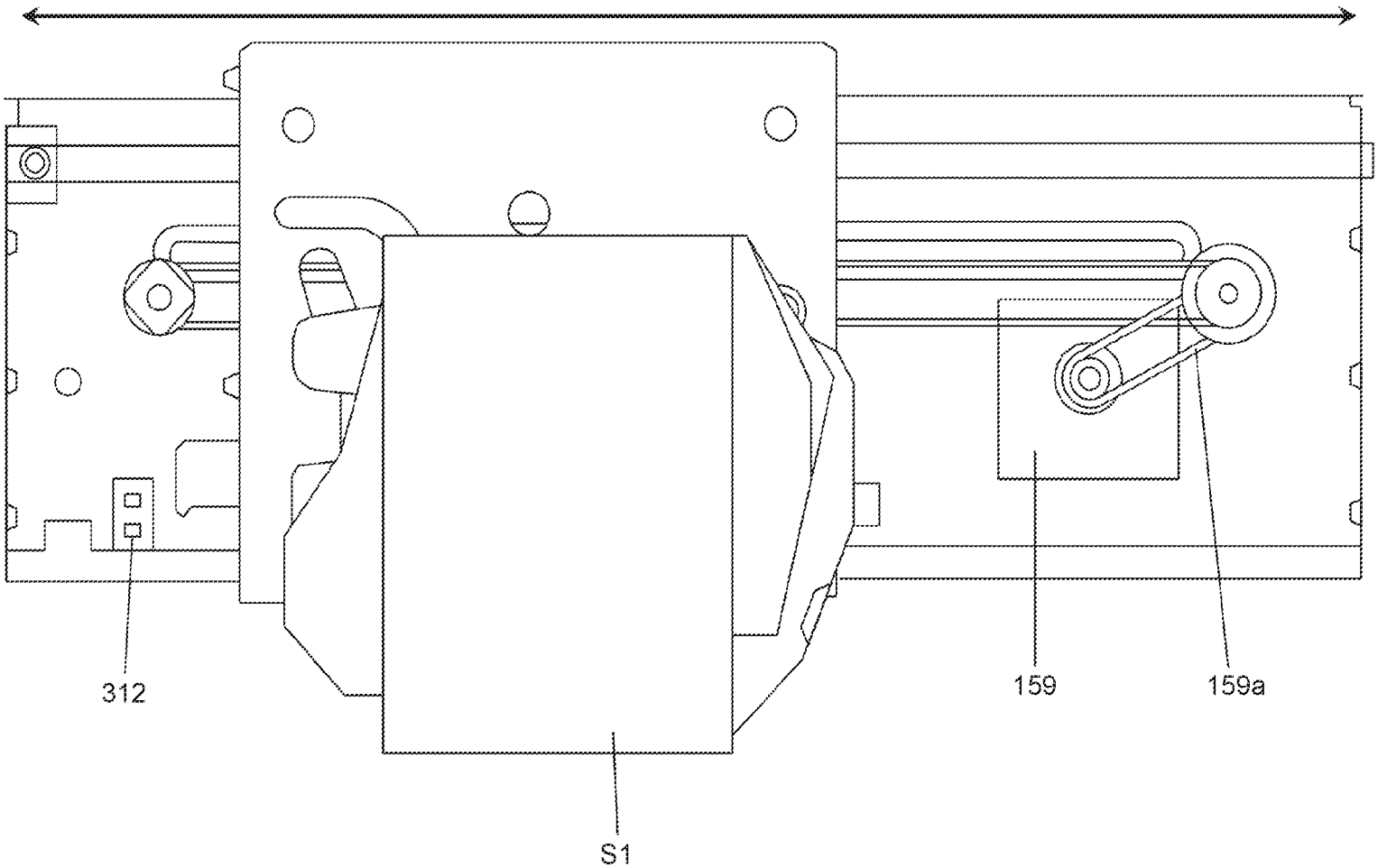
FIG. 7 is a side view that illustrates a stapler according to the embodiment in a sub-scanning direction.

Next, with reference to FIG. 7, an explanation is given of a moving mechanism of the end-face stitching stapler S1 according to the present embodiment. FIG. 7 is a side view that illustrates the stapler S1 according to the present embodiment in the sub-scanning direction.

As illustrated in FIG. 7, the end-face stitching stapler S1 is driven via a timing belt 159*a* by a stapler moving motor 159, which is rotatable in the normal and opposite directions, and is moved in the sheet width direction so that the sheet trailing edge is stitched at a predetermined position. That is, according to the present embodiment, the stapler moving motor 159 serves as a sheet-processing moving unit. A stapler movement HP sensor 312 is provided at one end within the movable range to detect the home position of the end-face stitching stapler S1.

The stitching position along the sheet width direction is controlled in accordance with the moving distance of the end-face stitching stapler S1 from the above-described home position. The end-face stitching stapler S1 is configured to stitch the sheet trailing edge at one or more points (usually, two points) and is configured to be movable along the entire width of the sheet trailing edge that is supported by at least the trailing-edge reference fences 51*a*, 51*b*.

Furthermore, the maximum possible movement is possible to the edge side of the device for replacement of the staple, whereby the convenience for users of the staple replacement operation is achieved.

Figure 8A:
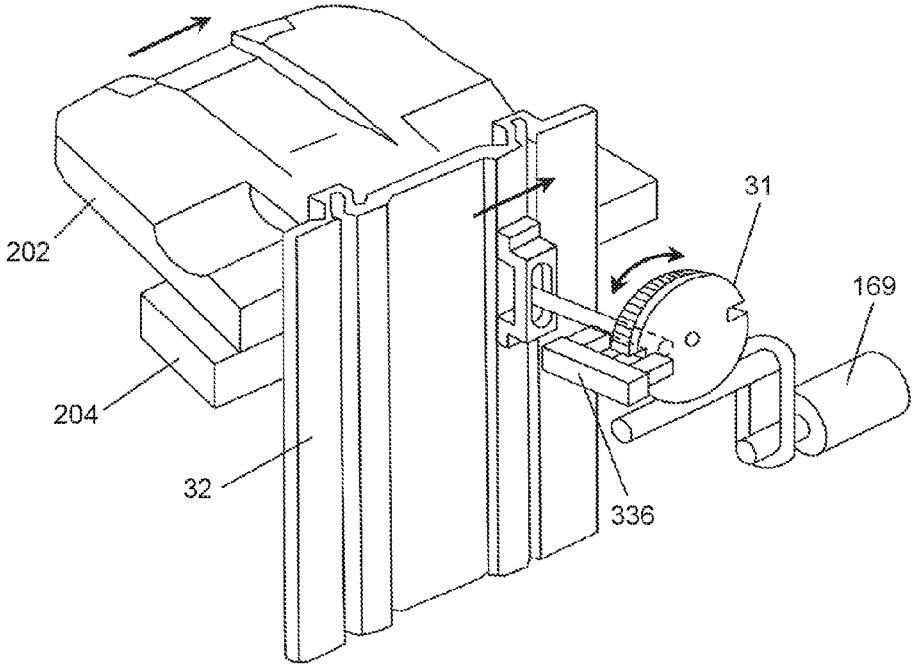
FIGS. 8A and 8B are perspective views of a moving mechanism of a shift tray according to the embodiment.
Figure 8B:
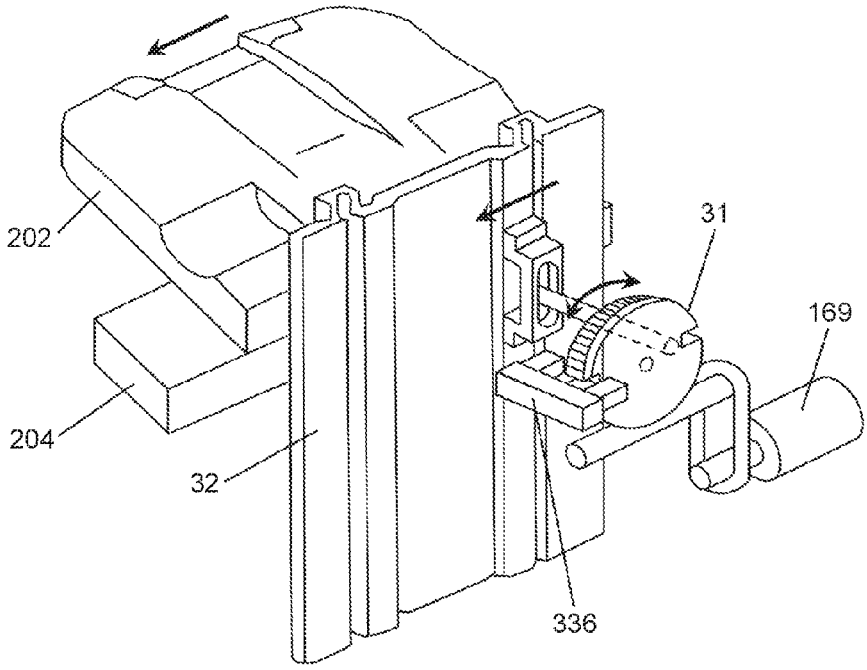

Next, with reference to FIGS. 8A and 8B, an explanation is given of the mechanism for moving the shift tray 202 in the main scanning direction according to the present embodiment. FIGS. 8A and 8B are perspective views of the moving mechanism of the shift tray 202 according to the present embodiment.

As illustrated in FIGS. 8A and 8B, in the mechanism for moving the shift tray 202 in the main scanning direction according to the present embodiment, the shift tray 202 is supported by a tray support plate 204 in the direction of gravitational force so as to be movable in the main scanning direction. Furthermore, an end fence 32 is fixed to the shift tray 202.

As illustrated in FIGS. 8A and 8B, to move the shift tray 202 in the main scanning direction, the post-processing device PD first drives a tray shift motor 169, which is rotatable in the normal and opposite directions, thereby rotating a power cam 31 in the direction of the arrow that is illustrated in FIGS. 8A and 8B. Thus, the driving force of the tray shift motor 169 is transmitted to the end fence 32 via the power cam 31.

When the driving force of the tray shift motor 169 is transmitted, the end fence 32 is moved in the direction of the arrow that is illustrated in FIGS. 8A and 8B, i.e., in the main scanning direction. Then, the shift tray 202 is moved along the tray support plate 204 in accordance with the movement of the end fence 32 so as to be moved in the main scanning direction.

Furthermore, the power cam 31 includes two cutout sections and, the post-processing device PD detects the cutout section by using a sensor 336, thereby detecting the position of the shift tray 202 in the main scanning direction.

Figure 9:
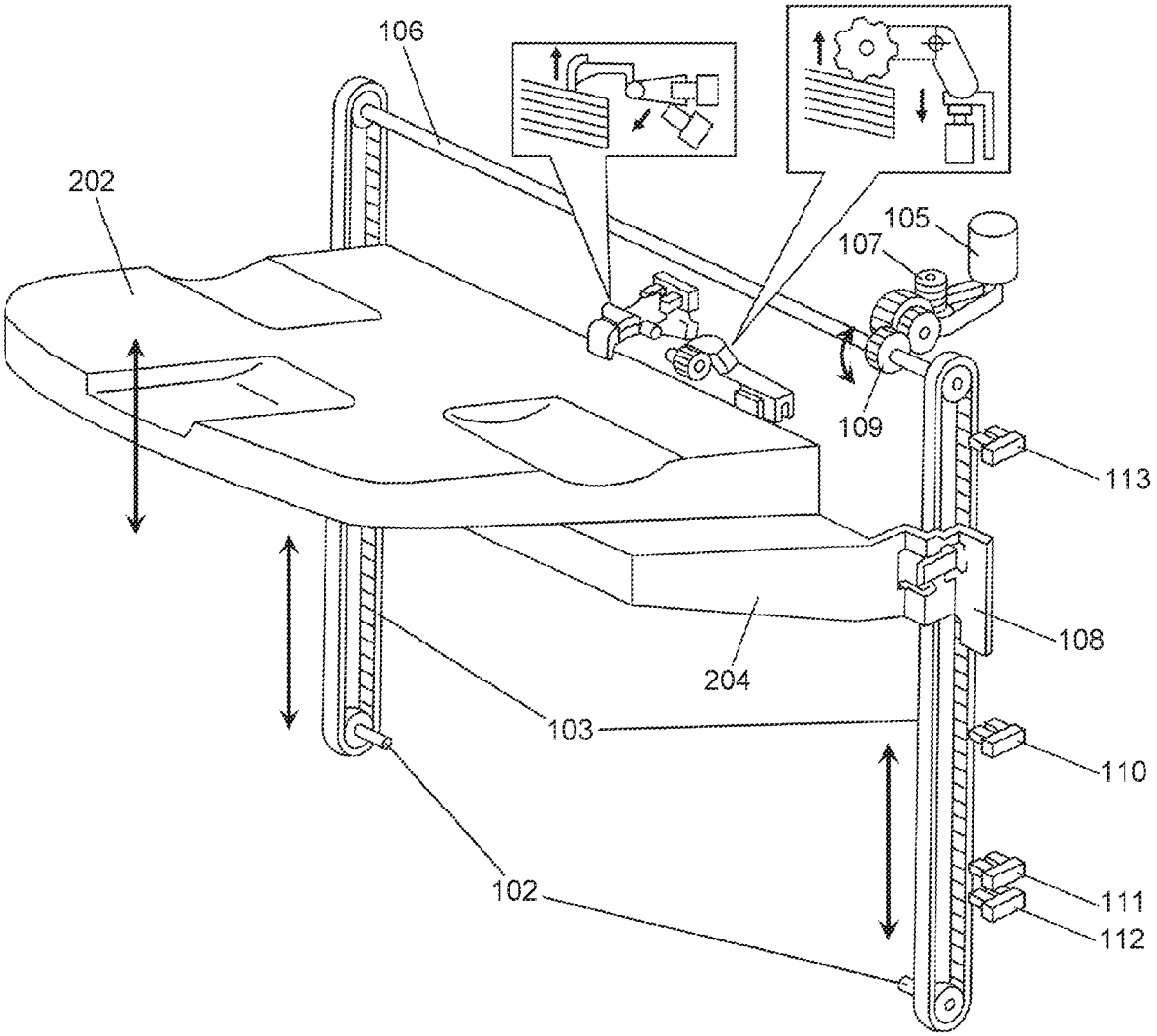
FIG. 9 is a perspective view of a lifting and lowering mechanism of the shift tray according to the embodiment.

Next, with reference to FIG. 9, an explanation is given of the lifting and lowering mechanism of the shift tray 202 according to the present embodiment. FIG. 9 is a perspective view of the lifting and lowering mechanism of the shift tray 202 according to the present embodiment.

As illustrated in FIG. 9, in the lifting and lowering mechanism of the shift tray 202 according to the present embodiment, a timing belt 103 is extended between a drive shaft 106 and a driven shaft 102 via timing pulleys with tensions applied thereto. The tray support plate 204 is fixed to the timing belt 103, and the shift tray 202 is suspended such that it may be lifted and lowered by the timing belt 103.

As illustrated in FIG. 9, to lift and lower the shift tray 202, the post-processing device PD first drives a tray lifting/lowering motor 105, which is rotatable in the normal and opposite directions, to rotate a rotation gear 109 in the direction of the arrow that is illustrated in FIG. 9 via a worm gear 107, thereby rotating the drive shaft 106 in the same direction. Thus, the driving force of the tray lifting/lowering motor 105 is transmitted to the timing belt 103.

When the driving force of the tray lifting/lowering motor 105 is transmitted, the timing belt 103 is moved in the direction of the arrow that is illustrated in FIG. 9, i.e., in the vertical direction, and the shift tray 202 is lifted and lowered in accordance with the movement of the tray support plate 204, which is caused by the movement of the timing belt 103.

In this way, the post-processing device PD lifts and lowers the shift tray 202 by using the tray lifting/lowering motor 105 via the worm gear 107, thereby making it possible to hold the shift tray 202 at a certain position and to prevent the shift tray 202 from dropping.

Furthermore, the tray support plate 204 is integrally formed with a shielding plate 108, and sensors 110, 111, 112, and 113 are arranged along the timing belt to detect the position of the tray support plate 204. Furthermore, by detecting the shielding plate 108 by using the sensors 110, 111, 112, and 113, the post-processing device PD is capable of detecting the position of the shift tray in the lifting and lowering direction.

Figure 10:
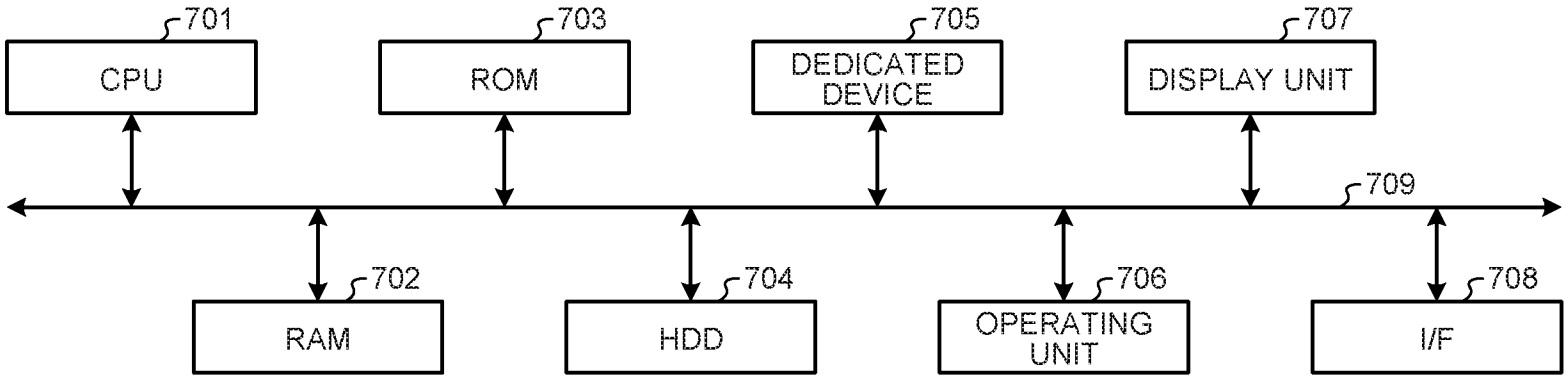
FIG. 10 is a block diagram that schematically illustrates a hardware configuration of the post-processing device according to the embodiment.

Next, with reference to FIG. 10, an explanation is given of a hardware configuration of the post-processing device PD according to the present embodiment. FIG. 10 is a block diagram that schematically illustrates a hardware configuration of the post-processing device PD according to the present embodiment. Furthermore, in FIG. 10, the hardware configuration of the post-processing device PD is explained as an example; however, the same holds for the image forming device PR.

As illustrated in FIG. 10, the post-processing device PD according to the present embodiment has a configuration such that a central processing unit (CPU) 701, a random access memory (RAM) 702, a read only memory (ROM) 703, a hard disk drive (HDD) 704, a dedicated device 705, an operating unit 706, a display unit 707, and a communication I/F 708 are connected to one another via a bus 709.

The CPU 701 is a calculating unit, and it controls the overall operation of the post-processing device PD. The RAM 702 is a volatile storage medium that is capable of reading and writing information at high speed, and it is used as a work area when the CPU 701 processes information. The ROM 703 is a non-volatile read-only storage medium, and it stores programs, such as firmware.

The HDD 704 is a non-volatile storage medium that is capable of reading and writing information, and it stores various types of data, such as image data, or various programs, such as an operating system (OS), various control programs, or application programs.

The dedicated device 705 is the hardware for implementing a dedicated function in the post-processing device PD, i.e., the hardware for implementing a dedicated function during a folding operation, bookbinding operation, stitching operation, or the like. Furthermore, in the image forming device PR, the document reading device PA, and the sheet feeding device PB, the dedicated device 705 is the hardware for implementing a dedicated function in each device, i.e., the hardware for implementing a dedicated function in the printer, facsimile machine, scanner, or copier.

The operating unit 706 is a user interface for inputting information to the post-processing device PD, and it is implemented by using an input device, such as a keyboard, mouse, or touch panel.

The display unit 707 is a visual user interface for checking the state of the post-processing device PD by a user, and it is implemented by using a display device, such as a liquid crystal display (LCD).

The I/F 708 is an interface, with which the post-processing device PD communicates with a different device, and an interface, such as Ethernet (registered trademark), universal serial bus (USB) interface, Peripheral Component Interconnect Express (PCIe) interface, is used.

With this hardware configuration, the RAM 702 reads a program, which is stored in the ROM 703, the HDD 704, or a storage medium such as an optical disk, and the CPU 701 performs calculations in accordance with the program that is loaded into the RAM 702, whereby a software control unit is configured. With the combination of the software control unit, which is configured as above, and the hardware, the functional block that implements the function of the post-processing device PD according to the present embodiment is configured.

Figure 11:
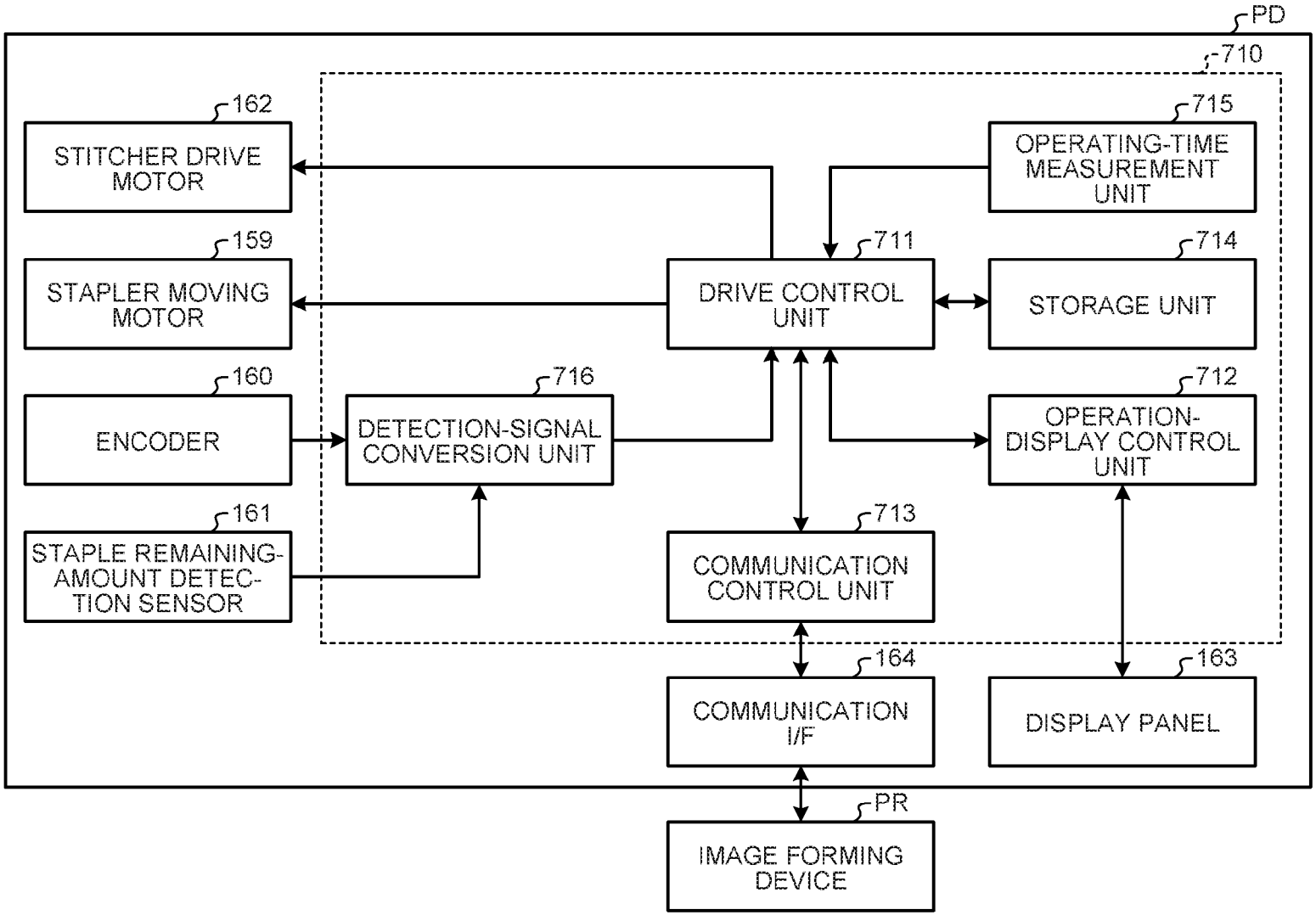
FIG. 11 is a block diagram that schematically illustrates a functional configuration of the post-processing device according to the embodiment.

Next, with reference to FIG. 11, an explanation is given of a functional configuration of the post-processing device PD according to the present embodiment. FIG. 11 is a block diagram that schematically illustrates a functional configuration of the post-processing device PD according to the present embodiment.

As illustrated in FIG. 11, the post-processing device PD according to the present embodiment includes a stapler moving motor 159, an encoder 160, a staple remaining-amount detection sensor 161, a stitcher drive motor 162, a display panel 163, a communication I/F 164, and a controller 710. Furthermore, the controller 710 includes a drive control unit 711, an operation-display control unit 712, a communication control unit 713, a storage unit 714, an operating-time measurement unit 715, and a detection-signal conversion unit 716.

The stapler moving motor 159 moves the end-face stitching stapler S1 under the control of the drive control unit 711. The encoder 160 detects the amount of displacement of the stapler moving motor 159 and inputs the detection signal to the detection-signal conversion unit 716.

The staple remaining-amount detection sensor 161 detects the remaining amount of the stitching staple (hereafter, "staple remaining amount") of the end-face stitching stapler S1 and inputs the detection signal to the detection-signal conversion unit 716. The stitcher drive motor 162 drives the stitcher S1*a* of the end-face stitching stapler S1 under the control of the drive control unit 711.

The display panel 163 is an output interface for visually displaying the state of the post-processing device PD, and it is also an input interface when a user directly operates the post-processing device PD as a touch panel or inputs information to the post-processing device PD. That is, the display panel 163 has a function to display an image for receiving a user's operation. The display panel 163 is implemented by using the operating unit 706 and the display unit 707, which are illustrated in FIG. 10.

Furthermore, the user is capable of inputting the usage conditions of the end-face stitching stapler S1, such as the moving distance of the end-face stitching stapler S1, the operating time, the number of times a move is made, the number of times stitching is performed, or the staple remaining amount, by operating the display panel 163. Therefore, the user may change or reset the usage condition of the end-face stitching stapler S1 when the stitching staple is supplied, or when a component of the end-face stitching stapler S1 or the stapler moving motor 159 is replaced.

The communication I/F 164 is an interface, with which the post-processing device PD communicates with the image forming device PR, and an interface, such as a USB or PCIe interface, is used. The communication I/F 164 is implemented by using the I/F 708 that is illustrated in FIG. 10. Various parameters, necessary for control, such as the operation information, the stacking condition of a sheet bundle, the sheet information, or the sheet conveying timing, are transmitted from the image forming device PR to the post-processing device PD according to the present embodiment via the communication I/F 164.

The controller 710 is configured by using the combination of software and hardware. Specifically, the controller 710 is configured by using the hardware, such as an integrated circuit, and the software control unit, which is configured when a control program, such as firmware, stored in a non-volatile storage medium such as the ROM 703 or the HDD 704, is loaded into the RAM 702 and calculation is performed by the CPU 701 in accordance with the program.

The drive control unit 711 performs a function to control each unit that is included in the controller 710, and it gives a command to each unit of the controller 710.

Furthermore, the drive control unit 711 counts the staple remaining amount on the basis of a detection signal that is input from the staple remaining-amount detection sensor or estimates it by counting the number of times stitching is performed by the end-face stitching stapler S1.

The operation-display control unit 712 displays information on the display panel 163 or notifies the drive control unit 711 of the information that is input via the display panel 163. Furthermore, the drive control unit 711 stores the information, which is notified by the operation-display control unit 712, in the storage unit 714 or gives a command to each unit of the controller 710 in accordance with the information that is notified by the operation-display control unit 712.

The communication control unit 713 inputs a signal or command, which is input via the communication I/F 164, to the drive control unit 711. Furthermore, the drive control unit 711 stores a signal or command, which is input from the communication control unit 713, in the storage unit 714 or gives a command to each unit of the controller 710 in accordance with a signal or command that is input from the communication control unit 713.

The storage unit 714 stores a parameter that is input by a user's operation on the display panel 163, various parameters that are transmitted from the image forming device PR, and the usage condition of the end-face stitching stapler S1. The operating-time measurement unit 715 measures the operating time of the end-face stitching stapler S1 and inputs it to the drive control unit 711. Furthermore, the drive control unit 711 stores the input operating time in the storage unit 714 as the usage condition.

The detection-signal conversion unit 716 converts the detection signal, input from the encoder 160, into drive information, such as moving distance, moving speed, or moving acceleration, and inputs it to the drive control unit 711. Thus, the drive control unit 711 is capable of acquiring the current drive state of the stapler moving motor 159, the total number of times the stapler moving motor 159 is moved so far, and the total moving distance. Furthermore, the drive control unit 711 stores the number of times it is moved and the moving distance, which are acquired, in the storage unit 714.

Furthermore, the detection-signal conversion unit 716 converts the detection signal, input from the staple remaining-amount detection sensor 161, into the staple remaining amount and inputs it to the drive control unit 711. Furthermore, the drive control unit 711 stores the input staple remaining amount in the storage unit 714 as the usage condition.

Furthermore, the drive control unit 711 may be configured to detect the staple remaining amount on the basis of the detection signal that is input from the staple remaining-amount detection sensor 161 or count the number of times the stitcher drive motor 162 is driven, i.e., count the number of times the end-face stitching stapler S1 performs stitching and, based on the count value, estimate the staple remaining amount. Furthermore, the drive control unit 711 stores the staple remaining amount, which is estimated as above, in the storage unit 714.

Figure 12:
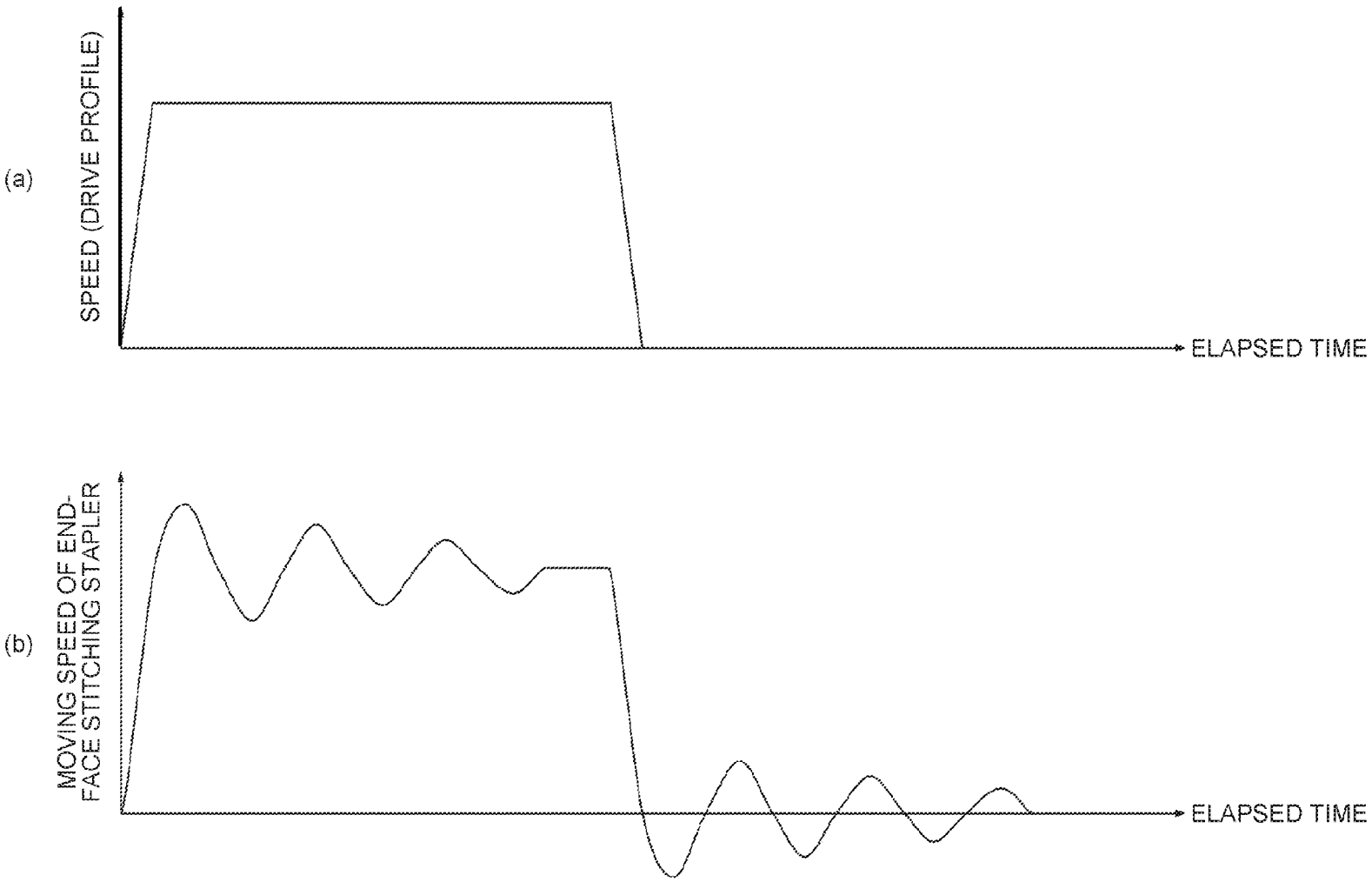
FIG. 12 illustrates the drive profile of a stapler moving motor and the speed variation of the end-face stitching stapler when a conventional post-processing device moves the end-face stitching stapler.

Next, with reference to FIG. 12, an explanation is given of the drive profile of the stapler moving motor 159 and the speed variation of the end-face stitching stapler S1 when a conventional post-processing device moves the end-face stitching stapler S1 in a main scanning direction.

In FIG. 12, (a) is a graph that illustrates the drive profile of the stapler moving motor 159 when a conventional post-processing device moves the end-face stitching stapler S1 in the main scanning direction. In FIG. 12, (b) is a graph that illustrates the speed variation of the end-face stitching stapler S1 when the conventional post-processing device moves the end-face stitching stapler S1 in the main scanning direction.

When the conventional post-processing device moves the end-face stitching stapler S1 in the main scanning direction, it performs control so as to drive the stapler moving motor 159 in accordance with the drive profile that is illustrated in (a) in FIG. 12. Hereafter, the drive profile that is illustrated in (a) in FIG. 12 is referred to as "usual drive profile (non-controlled vibration)".

However, here, as illustrated in (b) in FIG. 12, in the end-face stitching stapler S1, when the stapler moving motor 159 is completely started up and when it is stopped, i.e., when acceleration is terminated, speed variations occur, and the periodic natural vibration is generated. This is because, if the mass of the end-face stitching stapler S1 is M, the force F=Ma acts on the end-face stitching stapler S1 in a moving direction during acceleration.

Due to this force, the periodic natural vibration occurs in the end-face stitching stapler S1 when the stapler moving motor 159 is completely started up and when it is stopped, i.e., when acceleration is terminated. Furthermore, due to the occurrence of the periodic natural vibration, noise is generated in the conventional post-processing device when the end-face stitching stapler S1 is moved in the main scanning direction.

Furthermore, in the conventional post-processing device, if sheet processing is performed while the vibration occurs due to the movement of the end-face stitching stapler S1, it causes a decrease in the sheet processing accuracy; therefore, there is a need to delay the start of processing on the subsequent sheet until the vibration disappears, which reduces the productivity. Furthermore, the conventional post-processing device may have various problems due to the periodic natural vibration that occurs when the end-face stitching stapler S1 is moved.

Therefore, the post-processing device PD according to the present embodiment generates the drive profile to prevent the natural vibration of the end-face stitching stapler S1 when the end-face stitching stapler S1 is moved and, in accordance with the generated drive profile, performs control so as to drive the stapler moving motor 159.

Figure 13:
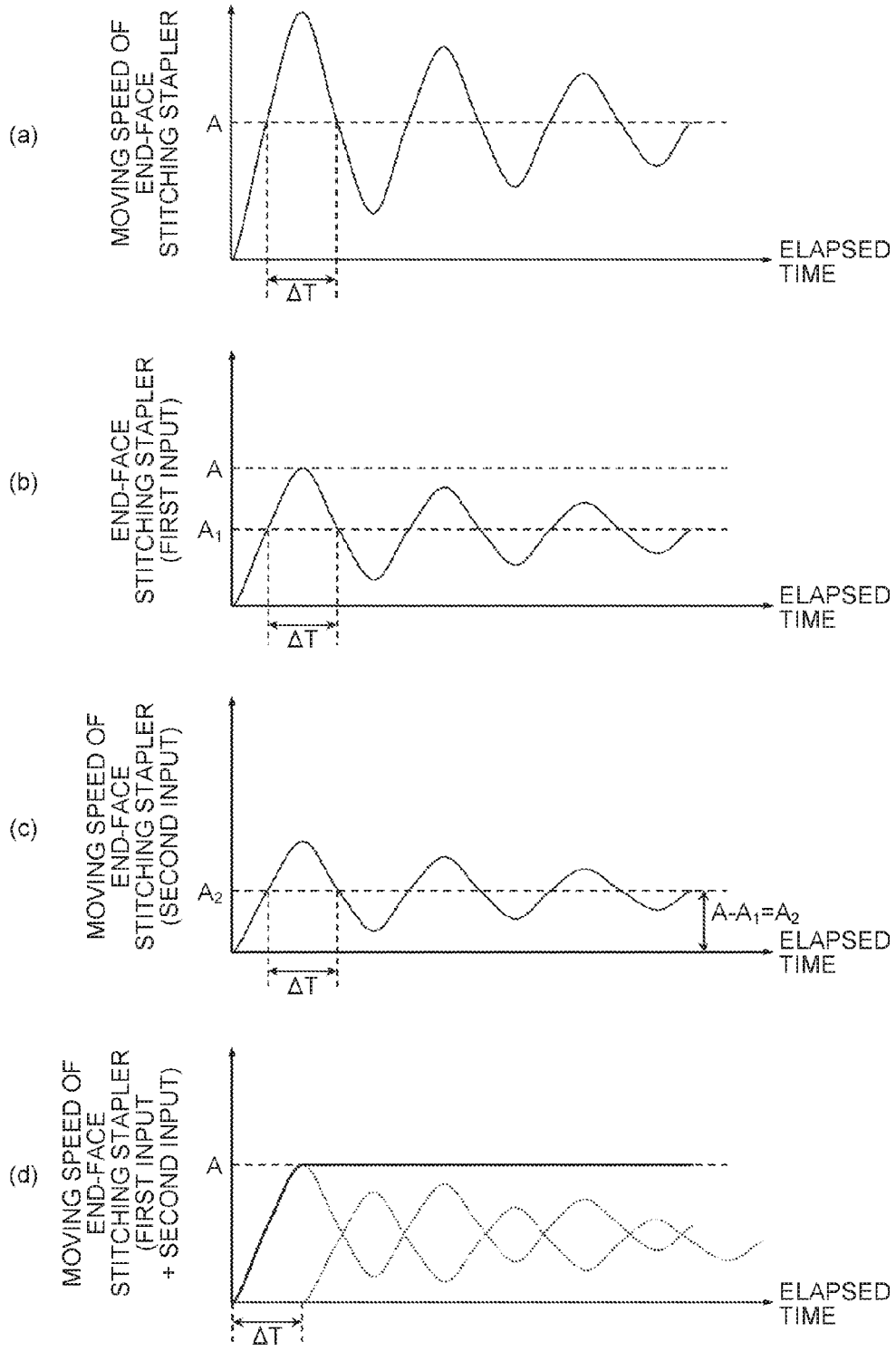
FIG. 13 illustrates the procedure for generating the drive profile of the stapler moving motor by the post-processing device according to the embodiment.
Figure 14:
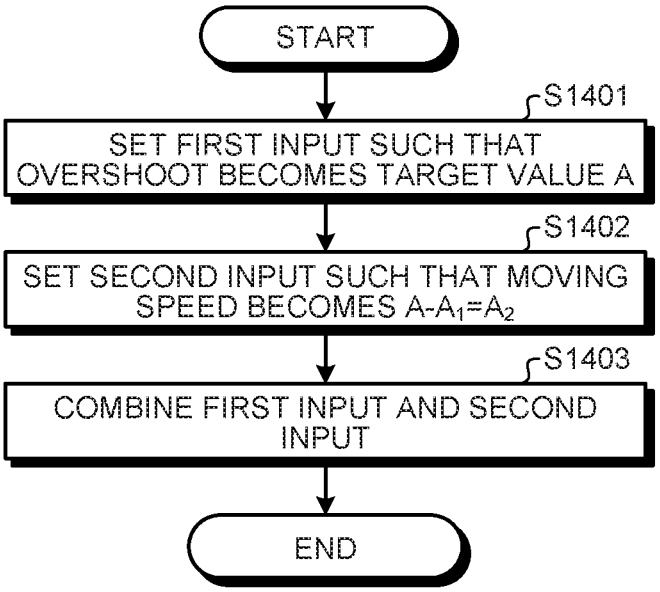
FIG. 14 is a flowchart that illustrates the procedure for generating the drive profile of the stapler moving motor by the post-processing device according to the embodiment.

Here, an explanation is given, with reference to FIGS. 13 and 14, of the procedure for generating the drive profile of the stapler moving motor 159 to prevent the natural vibration of the end-face stitching stapler S1 when the post-processing device PD according to the present embodiment moves the end-face stitching stapler S1.

FIG. 13 illustrates the procedure for generating the drive profile of the stapler moving motor 159 by the post-processing device PD according to the present embodiment. FIG. 14 is a flowchart that illustrates the procedure for generating the drive profile of the stapler moving motor 159 by the post-processing device according to the present embodiment.

As illustrated in FIGS. 13 and 14, to prevent the natural vibration of the shift tray 202, the post-processing device PD according to the present embodiment generates the drive profile, with which inputs are applied to the end-face stitching stapler S1 in two steps so that the natural vibration that occurs during the input in the first step is canceled by the natural vibration that occurs during the input in the second step. Furthermore, the post-processing device PD according to the present embodiment drives the stapler moving motor 159 in accordance with the drive profile that is generated as described above.

Specifically, as illustrated in (a) in FIG. 13, if the post-processing device PD according to the present embodiment makes an input to drive the stapler moving motor 159 such that the target value of the moving speed becomes A, the natural vibration occurs in the end-face stitching stapler S1 as described above.

Based on the above assumption, to prevent the natural vibration of the end-face stitching stapler S1, the post-processing device PD according to the present embodiment first sets the input (hereafter, referred to as "first input" or "first acceleration") such that the overshoot for the moving speed becomes the above-described target value A, as illustrated in (b) in FIG. 13 (S1401). In this way, when the stapler moving motor 159 is driven by using the first input, the natural vibration also occurs in the end-face stitching stapler S1. Here, the moving speed converges to A1.

Furthermore, the post-processing device PD according to the present embodiment sets the input (hereafter, referred to as "second input" or "second acceleration") such that the moving speed converges to $A-A_1=A_2$, as illustrated in (c) in FIG. 13 (S1402). In this way, when the stapler moving motor 159 is driven by using the second input, the natural vibration also occurs in the end-face stitching stapler S1.

Here, the frequency of the natural vibration that occurs due to the first input is the same as the frequency of the natural vibration that occurs due to the second input. Furthermore, here, the half cycle of the frequency of the natural vibration is ΔT.

Furthermore, the post-processing device PD according to the present embodiment sets the input by combining the first input and the second input with a time shift of ΔT from the acceleration start time by using the first input, as illustrated in (d) in FIG. 13. Specifically, the post-processing device PD according to the present embodiment sets the input to generate, by using the second input, the natural vibration with the phase opposite to that of the natural vibration that occurs due to the first input (S1403).

Figure 15:
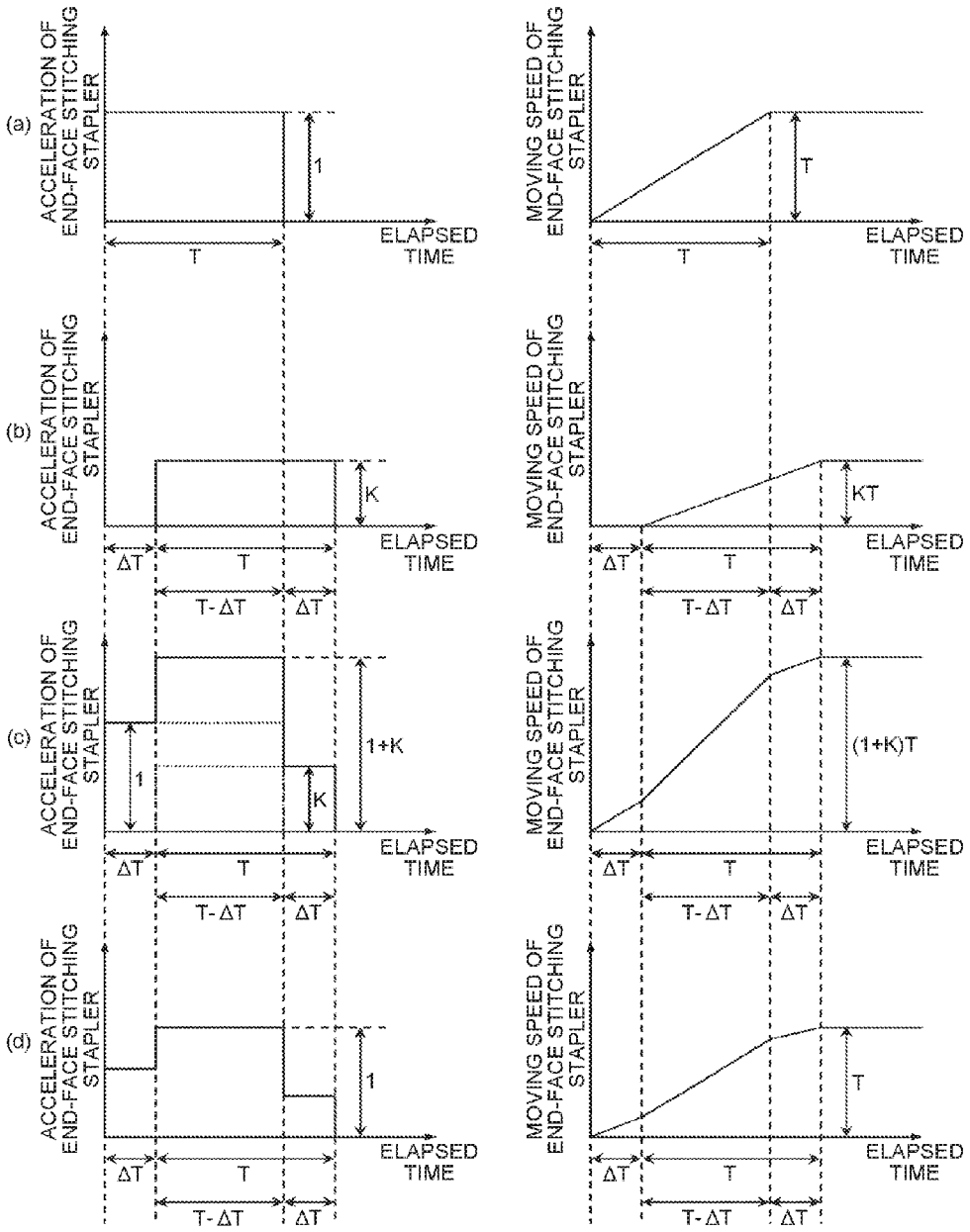
FIG. 15 illustrates the procedure for generating the drive profile of the stapler moving motor by the post-processing device according to the embodiment.
Figure 16:
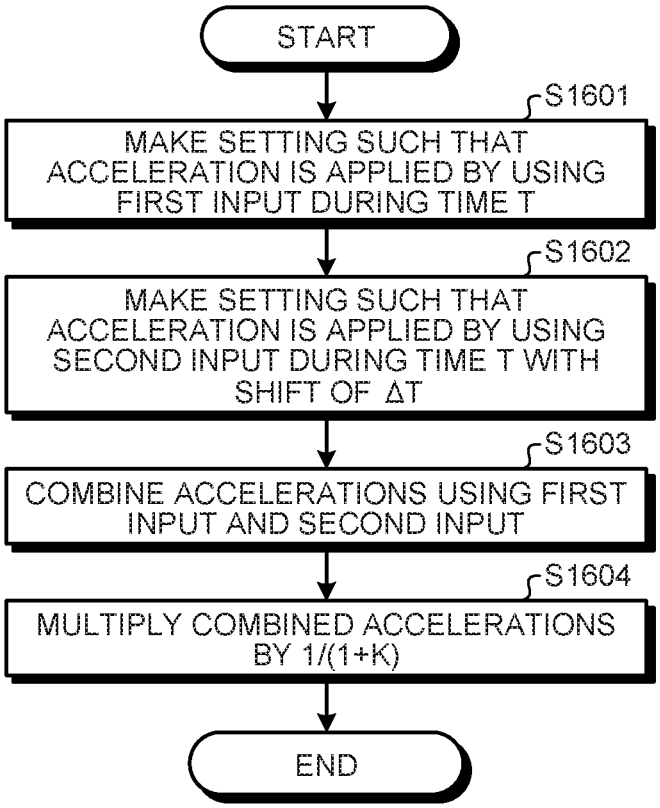
FIG. 16 is a flowchart that illustrates the procedure for generating the drive profile of the stapler moving motor by the post-processing device according to the embodiment.

Furthermore, with reference to FIGS. 15 and 16, an explanation is given of, as a different method, the procedure for generating the drive profile of the stapler moving motor 159 to prevent the natural vibration of the end-face stitching stapler S1 when the post-processing device PD according to the present embodiment moves the end-face stitching stapler S1.

FIG. 15 illustrates the procedure for generating the drive profile of the stapler moving motor 159 by the post-processing device PD according to the present embodiment. FIG. 16 is a flowchart that illustrates the procedure for generating the drive profile of the stapler moving motor 159 by the post-processing device PD according to the present embodiment.

As illustrated in FIGS. 15 and 16, to prevent the natural vibration of the end-face stitching stapler S1, the post-processing device PD according to the present embodiment generates the drive profile, with which accelerations are applied to the end-face stitching stapler S1 in two steps so that the natural vibration that occurs during the acceleration in the first step is canceled by the natural vibration that occurs during the acceleration in the second step. Furthermore, the post-processing device PD according to the present embodiment drives the stapler moving motor 159 in accordance with the drive profile that is generated as above.

Specifically, as illustrated in (a) in FIG. 15, to generate the drive profile of the stapler moving motor 159, the post-processing device PD according to the present embodiment first makes the setting such that the acceleration in the first step is applied to the end-face stitching stapler S1 as the first input (the first acceleration) during a time T at the start of acceleration of the end-face stitching stapler S1 (S1601). Here, the level of acceleration is 1. The speed variation of the end-face stitching stapler S1 in this step is illustrated in (a) in FIG. 17.

Furthermore, as illustrated in (b) in FIG. 15, the post-processing device PD according to the present embodiment makes the setting such that the acceleration in the second step is applied to the end-face stitching stapler S1 as the second input (the second acceleration) during the time T with the time shift of the half cycle (ΔT) of the frequency of the natural vibration that occurs due to the first input from the start time of the acceleration using the first input (S1602). Here, the level of acceleration is K. The speed variation of the end-face stitching stapler S1 in this step is illustrated in (b) in FIG. 17.

Afterward, as illustrated in (c) in FIG. 15, the post-processing device PD according to the present embodiment combines the acceleration using the first input and the acceleration using the second input, which are set as described above (S1603). Here, the state is such that the acceleration using the first input and the acceleration using the second input are simply combined; therefore, as illustrated in (c) in FIG. 15, the state is obtained such that the speed at the end of acceleration is the multiple of the supposed speed by (1+K).

Therefore, as illustrated in (d) in FIG. 15, to match the speed at the end of acceleration with the supposed speed, the post-processing device PD according to the present embodiment multiplies the combination acceleration, which is the combination of the acceleration using the first input and the acceleration using the second input, by 1/(1+K) (S1604). Thus, the speed at the end of acceleration becomes the same speed as the supposed speed. The speed variation of the end-face stitching stapler S1 in this step is illustrated in (c) in FIG. 17. Hereafter, the drive profile that is illustrated in (d) in FIG. 13 and (d) in FIG. 15 is referred to as "usual drive profile (controlled vibration)".

Furthermore, in a case where the natural vibration of the end-face stitching stapler S1 does not attenuate with the passage of time, if K=1, the post-processing device PD according to the present embodiment is capable of fully preventing the natural vibration of the end-face stitching stapler S1. However, in actuality, the natural vibration of the end-face stitching stapler S1 attenuates with the passage of time.

Therefore, to consider the attenuation of the end-face stitching stapler S1 with the passage of time, ΔT and K are defined by using the following Equations (1) and (2). Here, in Equations (1) and (2), w is the frequency of the natural vibration of the end-face stitching stapler S1, and ζ is the attenuation coefficient that represents the attenuation rate of the natural vibration of the end-face stitching stapler S1.

$$\Delta T = \frac{\pi}{\omega\sqrt{1-\zeta^2}} \tag{1}$$

$$K = \exp\left(-\frac{\zeta\pi}{\sqrt{1-\zeta^2}}\right) \tag{2}$$

Figure 17:
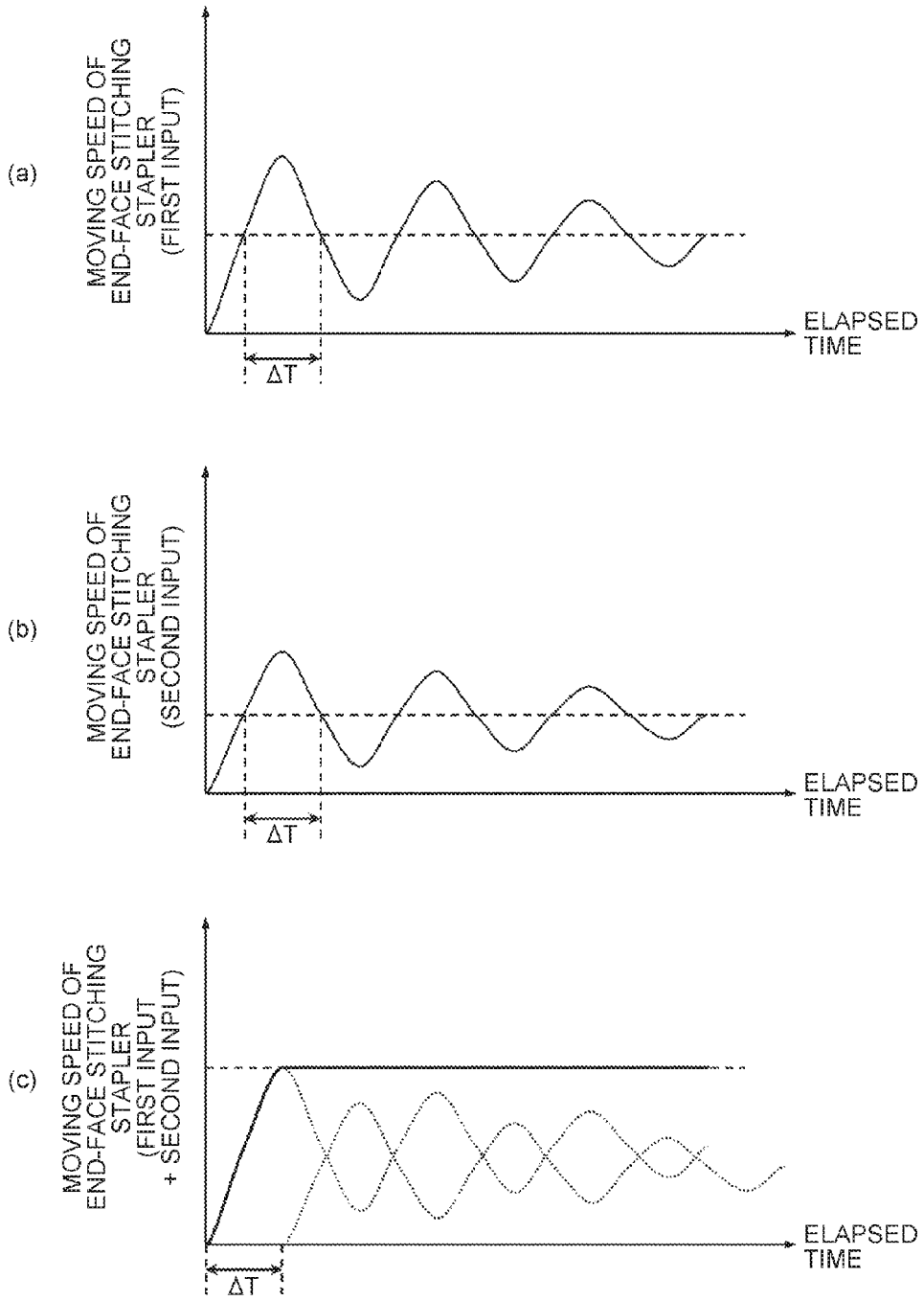
FIG. 17 illustrates the procedure for generating the drive profile of the stapler moving motor by the post-processing device according to the embodiment.
Figure 18:
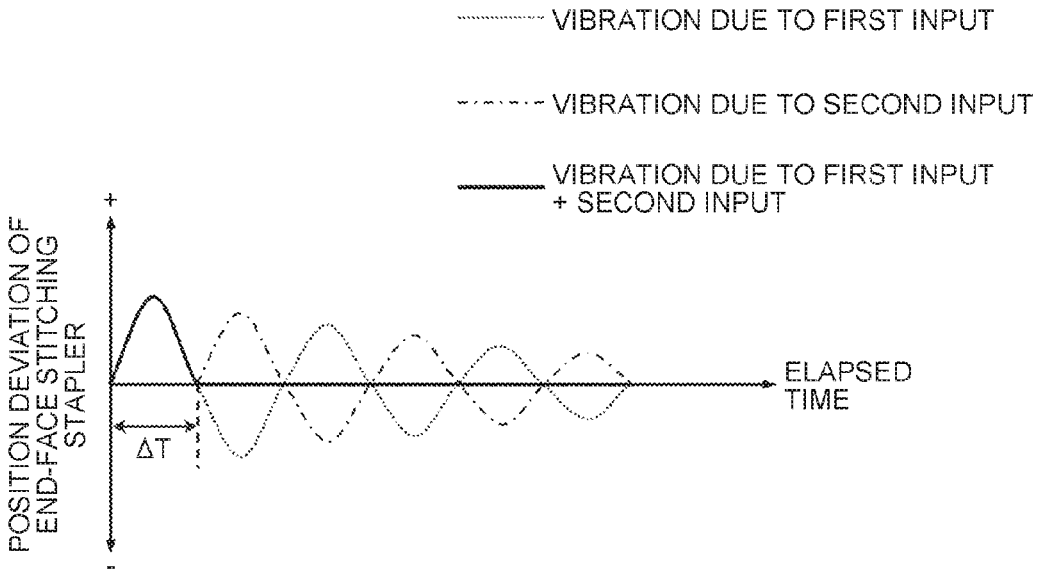
FIG. 18 is a graph that illustrates the position deviation when the stapler moving motor is driven by using the drive profile that is generated by the post-processing device according to the embodiment.

Here, FIG. 18 illustrates the position deviation when the stapler moving motor 159 is driven by using the drive profile that is generated during the procedure that is illustrated with reference to FIGS. 13 to 17 by the post-processing device PD according to the present embodiment. FIG. 18 illustrates the position deviation when the stapler moving motor 159 is driven by using the drive profile that is generated by the post-processing device PD according to the present embodiment.

As illustrated in FIG. 18, the post-processing device PD according to the present embodiment applies the second input with a time shift of the half cycle (ΔT) of the frequency of the natural vibration from the acceleration start time using the first input, whereby the natural vibration that has the phase opposite to that of the natural vibration that occurs due to the first input is generated by using the second input.

Specifically, in the post-processing device PD according to the present embodiment, the second input is applied with a time shift of the half cycle (ΔT) of the frequency of the natural vibration from the acceleration start time using the first input so that the natural vibrations, which are generated by using the first input and the second input, are canceled with each other. Thus, the post-processing device PD according to the present embodiment is capable of preventing the natural vibration of the end-face stitching stapler S1.

Furthermore, although an explanation is given of the time when the stapler moving motor 159 is started up in FIGS. 13 to 18, the same holds for the time when it is shut down. Hereafter, the technique for preventing the natural vibration of the end-face stitching stapler S1 according to the procedure that is explained with reference to FIGS. 13 and 14 is referred to as the "posicast method", and the technique for preventing the natural vibration of the end-face stitching stapler S1 according to the procedure that is explained with reference to FIGS. 15 to 17 is referred to as the "preshape method".

Figure 19:
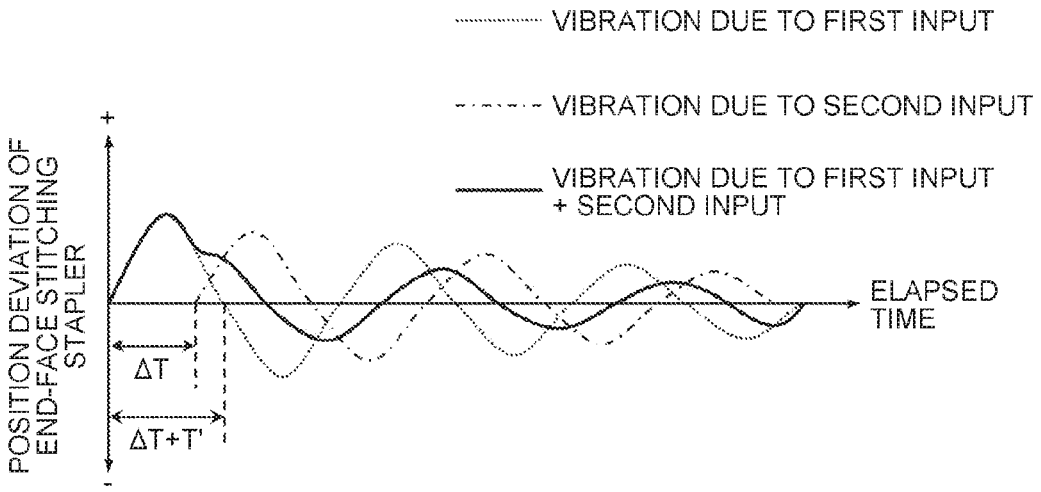
FIG. 19 is a graph that illustrates the position deviation of the end-face stitching stapler in the post-processing device according to the embodiment.

Furthermore, the frequency of the natural vibration of the end-face stitching stapler S1 is changed as illustrated in FIG. 19 depending on the usage condition of the end-face stitching stapler S1, such that the weight of the end-face stitching stapler S1 is changed due to the reduction of the stitching staple, the moving mechanism for moving the end-face stitching stapler S1 is degraded, or the like, each time the end-face stitching stapler S1 is used. Furthermore, in FIG. 19, the half cycle of the frequency of the natural vibration before a change is made is ΔT, and the half cycle of the frequency of the natural vibration after a change is made is ΔT+T'.

In this case, if the post-processing device PD according to the present embodiment applies the second input with a time shift ΔT from the acceleration start using the first input, the natural vibration due to the second input does not have the phase opposite to that of the natural vibration due to the first input. Therefore, in such a case, in the post-processing device PD according to the present embodiment, the natural vibration due to the first input is not canceled by the natural vibration due to the second input as illustrated in FIG. 19, and thus the natural vibration is not prevented.

Therefore, with the post-processing device PD according to the present embodiment, each time the end-face stitching stapler S1 is used, there is a decrease in the effect for preventing the natural vibration of the end-face stitching stapler S1.

Hence, the post-processing device PD according to the present embodiment is characterized in that it is configured to generate multiple drive profiles in advance in accordance with the usage condition of the end-face stitching stapler S1 and select a drive profile from the drive profiles in accordance with the usage condition of the end-face stitching stapler S1 when the end-face stitching stapler S1 is used.

Figure 20:
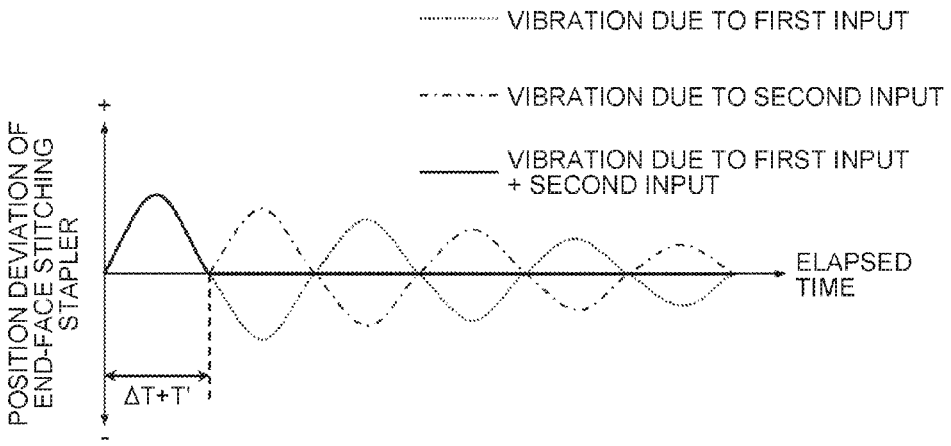
FIG. 20 is a graph that illustrates the position deviation of the end-face stitching stapler in the post-processing device according to the embodiment.

Specifically, as illustrated in FIG. 20, the post-processing device PD according to the present embodiment is configured to generate the drive profile such that the second input is applied to the stapler moving motor 159 with a time shift ΔT+T' from the acceleration start using the first input. As the post-processing device PD according to the present embodiment is configured as described above, the natural vibration due to the second input may have the phase opposite to that of the natural vibration due to the first input, even if the cycle of the frequency of the natural vibration of the end-face stitching stapler S1 is changed.

Therefore, the post-processing device PD according to the present embodiment may prevent the natural vibration of the end-face stitching stapler S1, even if the cycle of the frequency of the natural vibration is changed due to a change in the usage condition of the end-face stitching stapler S1.

Figure 21:
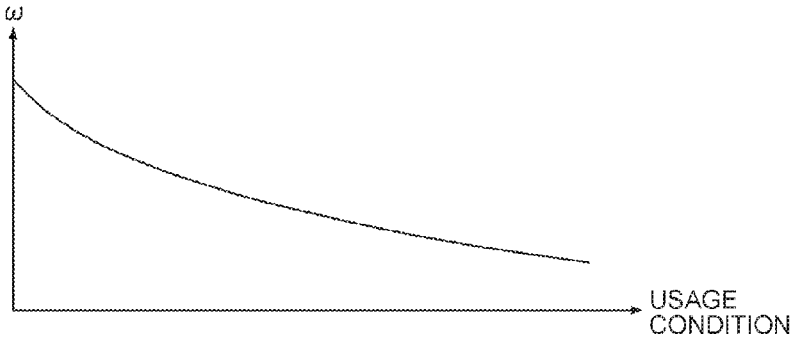
FIG. 21 is a graph that illustrates a change in the natural vibration frequency of the end-face stitching stapler in accordance with the usage condition of the end-face stitching stapler in the post-processing device according to the embodiment.
Figure 22:
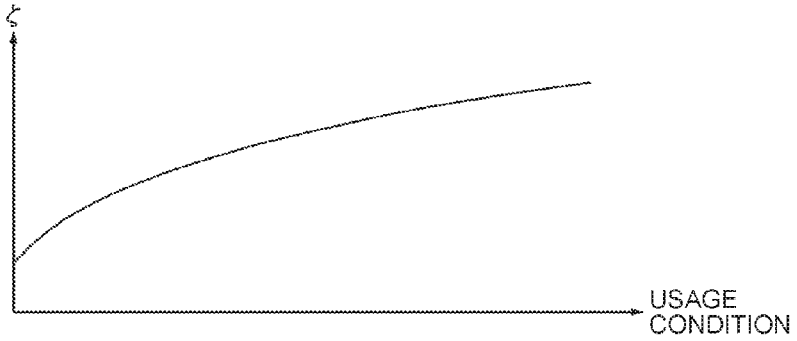
FIG. 22 is a graph that illustrates a change in the attenuation coefficient for the natural vibration of the end-face stitching stapler in accordance with the usage condition of the end-face stitching stapler in the post-processing device according to the embodiment.

Next, with reference to FIGS. 21 and 22, an explanation is given of a method for the post-processing device PD according to the present embodiment to generate a drive profile of the stapler moving motor 159 in accordance with the usage condition.

FIG. 21 is a graph that illustrates a change in the natural vibration frequency ω of the end-face stitching stapler S1 in accordance with the usage condition of the end-face stitching stapler S1 in the post-processing device PD according to the present embodiment. FIG. 22 is a graph that illustrates a change in the attenuation coefficient ζ for the natural vibration of the end-face stitching stapler S1 in accordance with the usage condition of the end-face stitching stapler S1 in the post-processing device PD according to the present embodiment.

When the post-processing device PD according to the present embodiment generates the drive profile of the stapler moving motor 159, ΔT, which is a parameter that represents the cycle of the natural vibration of the end-face stitching stapler S1, and K, which is a parameter that represents the acceleration using the second input, are needed as represented by Equations (1) and (2). Furthermore, the frequency ω of the natural vibration of the end-face stitching stapler S1 and the attenuation coefficient ζ of the natural vibration of the end-face stitching stapler S1 are needed to calculate ΔT and K.

Furthermore, as illustrated in FIGS. 21 and 22, the frequency ω of the natural vibration of the end-face stitching stapler S1 and the attenuation coefficient ζ for the natural vibration of the end-face stitching stapler S1 change in accordance with the usage condition of the end-face stitching stapler S1. Furthermore, the information that defines the relation between the usage condition and the frequency ω and the information that defines the relation between the usage condition and the attenuation coefficient ζ (hereafter, referred to as the "natural vibration information"), both illustrated in FIGS. 21 and 22, are stored in the storage unit 714.

Furthermore, the post-processing device PD according to the present embodiment is configured to calculate the cycle of the natural vibration of the end-face stitching stapler S1 on the basis of ω and ζ that are in accordance with the usage condition of the end-face stitching stapler S1 and generate the drive profile of the stapler moving motor 159 on the basis of the calculated cycle.

Therefore, with the post-processing device PD according to the present embodiment, even if the cycle of the frequency of the natural vibration is changed due to a change in the usage condition of the end-face stitching stapler S1, the natural vibration of the end-face stitching stapler S1 may be prevented.

Figure 23:
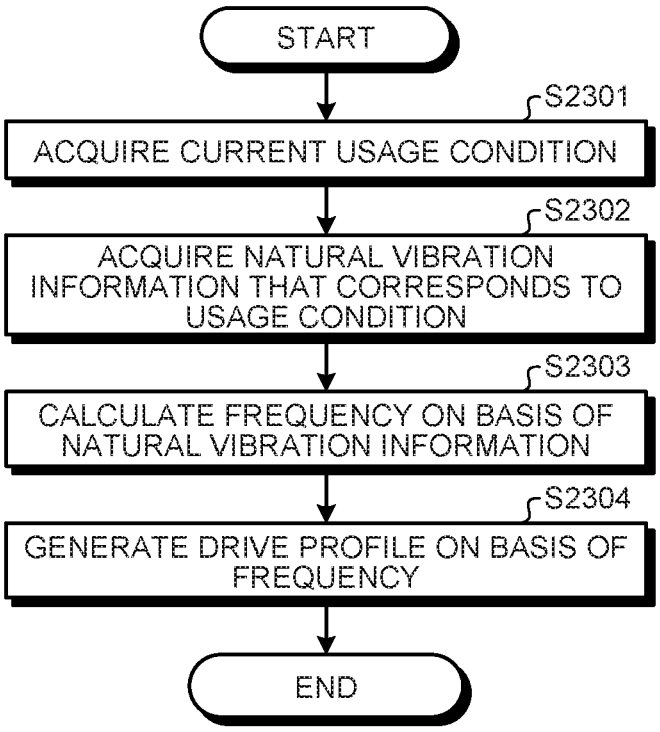
FIG. 23 is a flowchart that illustrates the operation to generate the drive profile of the stapler moving motor by the post-processing device according to the embodiment.

Next, with reference to FIG. 23, an explanation is given of an operation to generate the drive profile of the stapler moving motor 159 by the post-processing device PD according to the present embodiment. FIG. 23 is a flowchart that illustrates the operation to generate the drive profile of the stapler moving motor 159 by the post-processing device PD according to the present embodiment.

When the post-processing device PD according to the present embodiment generates the drive profile of the stapler moving motor 159, the drive control unit 711 first acquires the current usage condition of the end-face stitching stapler S1 from the storage unit 714 (52301) and acquires the natural vibration information that corresponds to the usage condition from the storage unit 714 (S2302).

Then, the drive control unit 711 calculates the cycle of the natural vibration of the end-face stitching stapler S1 on the basis of the natural vibration information, which is acquired at S2302 (S2303), and generates the drive profile of the stapler moving motor 159 on the basis of the calculated cycle (S2304). That is, according to the present embodiment, the drive control unit 711 functions as a drive-mode determining unit.

As described above, the post-processing device PD according to the present embodiment is configured to calculate the cycle of the natural vibration of the end-face stitching stapler S1 on the basis of the natural vibration information that corresponds to the usage condition of the end-face stitching stapler S1 and to generate the drive profile of the stapler moving motor 159 on the basis of the calculated cycle.

Therefore, with the post-processing device PD according to the present embodiment, even if the cycle of the frequency of the natural vibration changes due to a change in the usage condition of the end-face stitching stapler S1, it is possible to prevent the natural vibration of the end-face stitching stapler S1.

Figure 24:
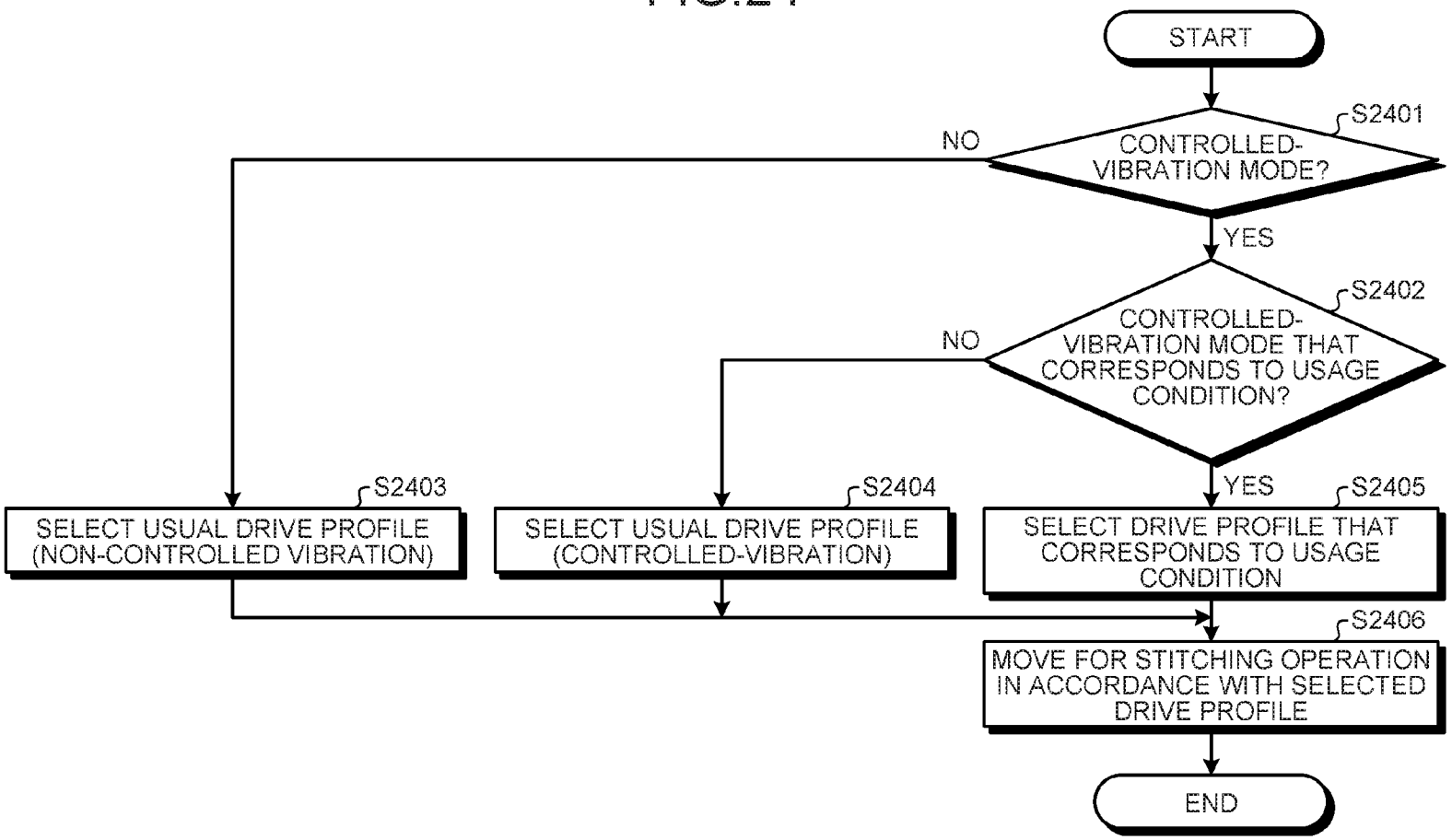
FIG. 24 is a flowchart that illustrates the operation when the end-face stitching stapler performs a stitching operation in the post-processing device according to the embodiment.

Next, with reference to FIG. 24, an explanation is given of an operation when the end-face stitching stapler S1 performs a stitching operation in the post-processing device PD according to the present embodiment. FIG. 24 is a flowchart that illustrates the operation when the end-face stitching stapler S1 performs a stitching operation in the post-processing device PD according to the present embodiment.

As illustrated in FIG. 24, when the post-processing device PD according to the present embodiment performs a stitching operation by using the end-face stitching stapler S1, the drive control unit 711 first determines whether either a controlled-vibration mode or a non-controlled vibration mode is set as the operation mode of the stapler moving motor 159 (S2401).

During the determination operation at S2401, if the drive control unit 711 determines that the non-controlled vibration mode is set as the operation mode of the stapler moving motor 159 (S2401, NO), the usual drive profile (non-controlled vibration) is selected (S2403).

Conversely, if it is determined that the controlled-vibration mode is set as the operation mode of the stapler moving motor 159 during the determination operation at S2401 (S2401, YES), the drive control unit 711 determines which one of the controlled-vibration mode, which corresponds to the usage condition, and the usual controlled-vibration mode is set as the operation mode of the stapler moving motor 159 (S2402).

If it is determined that the usual controlled-vibration mode is set as the operation mode of the stapler moving motor 159 during the determination operation at S2402 (S2402, No), the drive control unit 711 selects the usual drive profile (controlled-vibration) (S2404).

Conversely, if it is determined that the controlled-vibration mode, which corresponds to the usage condition, is set as the operation mode of the stapler moving motor 159 during the determination operation at S2402 (S2402, YES), the drive control unit 711 refers to the profile setting table to select the drive profile, which corresponds to the usage condition of the end-face stitching stapler S1, stored in the storage unit 714 (S2405).

Then, the drive control unit 711 drives the stapler moving motor 159 in accordance with the drive profile that is selected at any one of S2403 to S2405, thereby performing a stitching operation on the sheet bundle that is stacked on the end-face stitching processing tray F (S2406).

As described above, the post-processing device PD according to the present embodiment is configured to perform a stitching operation by using the usual drive profile (controlled-vibration) if the controlled-vibration mode is set as the operation mode of the stapler moving motor 159. Alternatively, the post-processing device PD according to the present embodiment is configured to perform a stitching operation by using the drive profile that is based on the usage condition of the end-face stitching stapler S1 if the controlled-vibration mode is set as the operation mode of the stapler moving motor 159.

Conversely, the post-processing device PD according to the present embodiment is configured to perform a stitching operation by using the usual drive profile (non-controlled vibration) if the non-controlled vibration mode is set as the operation mode of the stapler moving motor 159.

Therefore, the post-processing device PD according to the present embodiment may improve the productivity by setting the non-controlled vibration mode as the operation mode of the stapler moving motor 159 and, meanwhile it may prevent the vibration that occurs in the end-face stitching stapler S1 by setting the controlled-vibration mode.

Furthermore, in the post-processing device PD according to the present embodiment, in a case where the frequency of the natural vibration of the end-face stitching stapler S1 largely changes, for example, in a case where it changes by equal to or more than ¼ cycle, if vibration control is performed, the natural vibrations, which are generated due to the first input and the second input, cannot be canceled with each other and they are sometimes overlapped. Therefore, in such a case, in the post-processing device PD according to the present embodiment, the amplitude of the natural vibration becomes larger, compared to the case where vibration control is not performed.

Thus, the post-processing device PD according to the present embodiment is configured to set the non-controlled vibration mode as the operation mode of the stapler moving motor 159 if the amplitude of the natural vibration becomes larger when vibration control is performed, compared to the case where vibration control is not performed.

Furthermore, the post-processing device PD according to the present embodiment may be configured such that a user is capable of setting the operation mode of the stapler moving motor 159 by operating the display panel 163 via the operation-display control unit 712. Furthermore, the post-processing device PD according to the present embodiment may be configured such that the drive control unit 711 automatically sets the operation mode of the stapler moving motor 159 in accordance with the occurrence state of the natural vibration. That is, according to the present embodiment, the operation-display control unit 712 or the drive control unit 711 functions as a drive-mode setting unit.

As described above, with the post-processing device PD according to the present embodiment, the second input is applied with a time shift of the half cycle (ΔT) of the frequency of the natural vibration from the acceleration start time using the first input, whereby the natural vibration that has the phase opposite to that of the natural vibration that occurs due to the first input is generated by using the second input.

Specifically, in the post-processing device PD according to the present embodiment, the second input is applied with a time shift of the half cycle (ΔT) of the frequency of the natural vibration from the acceleration start time using the first input so that the natural vibrations, generated by using the first input and the second input, are canceled with each other. Thus, the post-processing device PD according to the present embodiment is capable of preventing the natural vibration of the end-face stitching stapler S1.

Furthermore, the post-processing device PD according to the present embodiment is characterized in that it is configured to previously generate multiple drive profiles in accordance with the usage condition of the end-face stitching stapler S1 and to select a drive profile from the drive profiles in accordance with the usage condition of the end-face stitching stapler S1 when the end-face stitching stapler S1 is used.

Specifically, as illustrated in FIG. 20, the post-processing device PD according to the present embodiment is configured to generate the drive profile such that the second input is applied to the stapler moving motor 159 with a time shift of ΔT+T' from the acceleration start using the first input. With the above configuration of the post-processing device PD according to the present embodiment, even if the cycle of the frequency of the natural vibration of the end-face stitching stapler S1 changes, the natural vibration due to the second input may have the phase opposite to that of the natural vibration due to the first input.

Therefore, with the post-processing device PD according to the present embodiment, even if the cycle of the frequency of the natural vibration changes due to a change in the usage condition of the end-face stitching stapler S1, the natural vibration of the end-face stitching stapler S1 may be prevented.

Heretofore, in the present embodiment, an explanation is given of the post-processing device PD that is configured to previously generate multiple drive profiles in accordance with the usage condition of the end-face stitching stapler S1 and to select a drive profile from the drive profiles in accordance with the usage condition of the end-face stitching stapler S1 when the end-face stitching stapler S1 is used. Furthermore, the post-processing device PD according to the present embodiment may be configured to generate a drive profile in accordance with the usage condition of the end-face stitching stapler S1 each time the end-face stitching stapler S1 is used.

Furthermore, in the present embodiment, an explanation is given of the vibration control for preventing the natural vibration that occurs when the end-face stitching stapler S1 is moved. Furthermore, the vibration control according to the present embodiment is applicable to prevent the natural vibration that occurs when a sheet processing unit, such as the punch unit 100, the jogger fence 53, the saddle-stitching upper jogger fence 250*a*, the saddle-stitching lower jogger fence 250*b*, the saddle-stitching stapler S2, the shift tray 202, or the release claw 52*a*, is moved.

This is because, the frequency of the natural vibration of the sheet processing unit also changes due to the usage condition, such as punch wastes, the weight of the bundle of sheets stacked, the moving distance, the number of times a move is made, or the operating time, and the effect of preventing the natural vibration is decreased on each usage, as is the case with the end-face stitching stapler S1.

Therefore, in such a case, the end-face stitching stapler S1 and the saddle-stitching stapler S2 serve as a stitching processing unit, the punch unit 100 as a sheet punching unit, the jogger fence 53, the saddle-stitching upper jogger fence 250*a*, and the saddle-stitching lower jogger fence 250*b* as a sheet aligning unit, the shift tray 202 as a sheet stack unit, and the release claw 52*a* as a sheet ejecting unit.

Furthermore, in the present embodiment, an explanation is given of the vibration control for preventing the natural vibration that occurs when the end-face stitching stapler S1, which stitches the sheet bundle by using the stitching staple, is moved. Furthermore, the vibration control according to the present embodiment is applicable to prevent the natural vibration that occurs when the end-face stitching stapler S1, which stitches the sheet bundle by using an adhesive agent, is moved.

Furthermore, in the present embodiment, an explanation is given of the post-processing device PD that is configured to calculate the frequency of the natural vibration of the end-face stitching stapler S1 on the basis of the usage condition of the end-face stitching stapler S1 and the natural vibration information and to generate the drive profile of the stapler moving motor 159 on the basis of the calculated frequency.

Furthermore, the post-processing device PD according to the present embodiment may be configured such that a user operates the display panel 163 so as to input the frequency of the natural vibration of the end-face stitching stapler S1 in accordance with the usage condition of the end-face stitching stapler S1.

Furthermore, in the present embodiment, an explanation is given of the post-processing device PD that previously stores the natural vibration information in the storage unit 714. Furthermore, the post-processing device PD according to the present embodiment may be configured such that a user operates the display panel 163 so as to input the natural vibration information in accordance with the usage condition of the end-face stitching stapler S1.

Furthermore, in the present embodiment, an explanation is given of the post-processing device PD that is configured to generate or determine a drive profile in accordance with the usage condition of the end-face stitching stapler S1. Furthermore, the post-processing device PD according to the present embodiment may be configured to generate or determine a drive profile in accordance with the usage condition of the stapler moving motor 159.

Furthermore, in the present embodiment, an explanation is given of the post-processing device PD that is configured to generate a drive profile such that the second input is applied with a time shift of the half cycle (ΔT) of the frequency of the natural vibration from the acceleration start time due to the first input. Furthermore, the post-processing device PD according to the present embodiment may be configured to generate a drive profile such that the second input is applied with a time shift of n.5 cycle (ΔT×n.5) of the frequency of the natural vibration from the acceleration start time due to the first input. Here, n is an integer greater than or equal to 0.

That is, the post-processing device PD according to the present embodiment may be configured to generate a drive profile such that the second input is applied with a shift of the time that is the addition of the time of the half cycle of the frequency of the natural vibration and the time of the integral multiple of the cycle of the natural vibration from the acceleration start time due to the first input.

Figure 25:
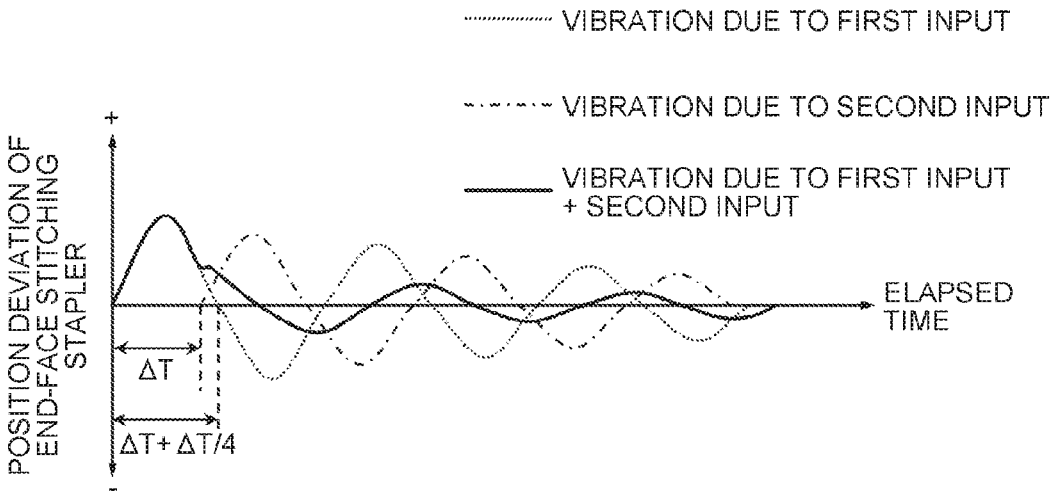
FIG. 25 is a graph that illustrates the position deviation of the end-face stitching stapler in the post-processing device according to the embodiment.

Furthermore, in addition, as illustrated in FIG. 25, if the post-processing device PD according to the present embodiment may prevent the natural vibration to some extent, the second input does not need to be always applied with a time shift of the half cycle (ΔT) of the frequency of the natural vibration from the acceleration start time due to the first input. Furthermore, FIG. 25 illustrates a case where the second input is applied with a time shift of ¼ cycle (ΔT/4) of the frequency of the natural vibration from the acceleration start time due to the first input.

Second Embodiment

In the first embodiment, an explanation is given of the post-processing device PD that is configured to apply the second input with a time shift of the half cycle (ΔT) of the frequency of the natural vibration from the acceleration start time due to the first input, thereby generating, by using the second input, the natural vibration that has the phase opposite to that of the natural vibration that is generated due to the first input.

Specifically, in the first embodiment, an explanation is given of the post-processing device PD that is configured to apply the second input with a time shift of the half cycle (ΔT) of the frequency of the natural vibration from the acceleration start time due to the first input so that the natural vibrations, generated by using the first input and the second input, are canceled with each other. With the above configuration of the post-processing device PD according to the first embodiment, it is possible to prevent the natural vibration of the end-face stitching stapler S1.

Furthermore, conventional post-processing devices are configured to perform vibration control on the basis of the information on the previously set natural vibration frequency. However, the natural vibration frequency, which occurs when the end-face stitching stapler S1 is moved, changes due to variations of components, the way of assembly, mechanical individual variability, or the usage condition. Therefore, with the conventional post-processing devices, as the actual natural vibration frequency does not match the previously set natural vibration frequency, the effect of the vibration control of the end-face stitching stapler S1 is decreased.

Therefore, the post-processing device PD according to the present embodiment is configured to measure the natural vibration frequency, which occurs when the end-face stitching stapler S1 is moved, and performs vibration control on the end-face stitching stapler S1 on the basis of the measured natural vibration frequency. With the above configuration of the post-processing device PD according to the present embodiment, even if the natural vibration frequency of the end-face stitching stapler S1 changes, the natural vibration may be prevented.

A detailed explanation is given below of an embodiment of the present invention with reference to the drawings. Furthermore, the component that is attached with the same reference numeral as that in the first embodiment indicates the same or equivalent unit, and detailed explanations are omitted.

Figure 26:
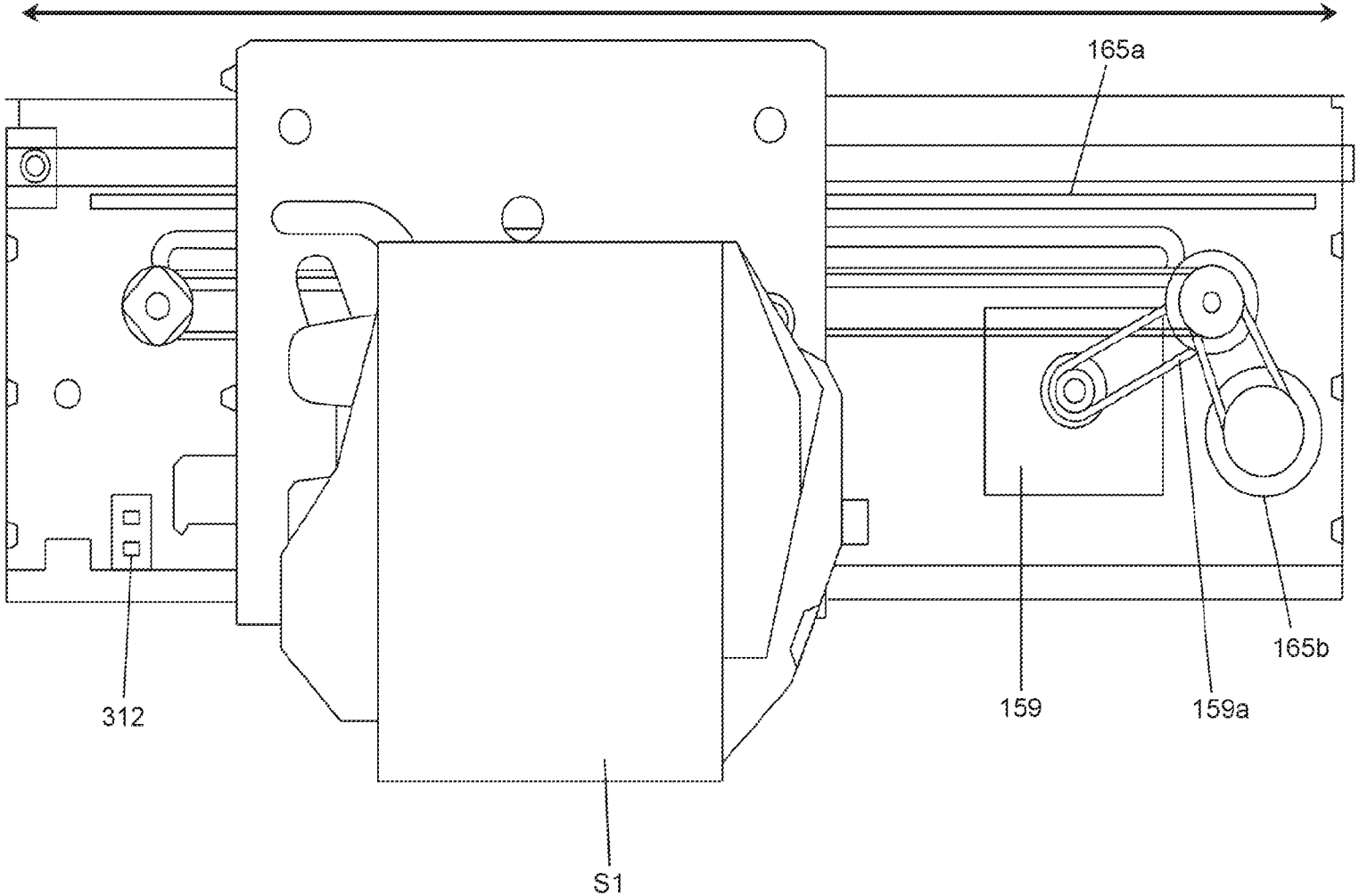
FIG. 26 is a side view that illustrates the stapler according to the embodiment in a sub-scanning direction.

First, with reference to FIG. 26, an explanation is given of the moving mechanism of the end-face stitching stapler S1 according to the present embodiment. FIG. 26 is a side view that illustrates the stapler S1 according to the present embodiment in the sub-scanning direction. As illustrated in FIG. 26, the end-face stitching stapler S1 includes position detection sensors 165*a* and 165*b*.

The position detection sensor 165*a* is a sensor that is implemented by using an optical rotary encoder, or the like, and that measures the position of the end-face stitching stapler S1 on the basis of the rotating speed of a drive shaft 166 of the end-face stitching stapler S1 to acquire positional information. The position detection sensor 165*b* is a sensor that is implemented by using a linear scale, or the like, and that measures the position of the end-face stitching stapler S1, which makes a linear movement, to acquire positional information. That is, according to the present embodiment, the position detection sensors 165*a* and 165*b* serve as a positional-information acquiring unit.

Furthermore, in the present embodiment, an explanation is given of the post-processing device PD that is configured to include both the position detection sensor 165*a* and the position detection sensor 165*b*; however, the post-processing device PD according to the present embodiment may be configured to include at least any one of them.

Figure 27:
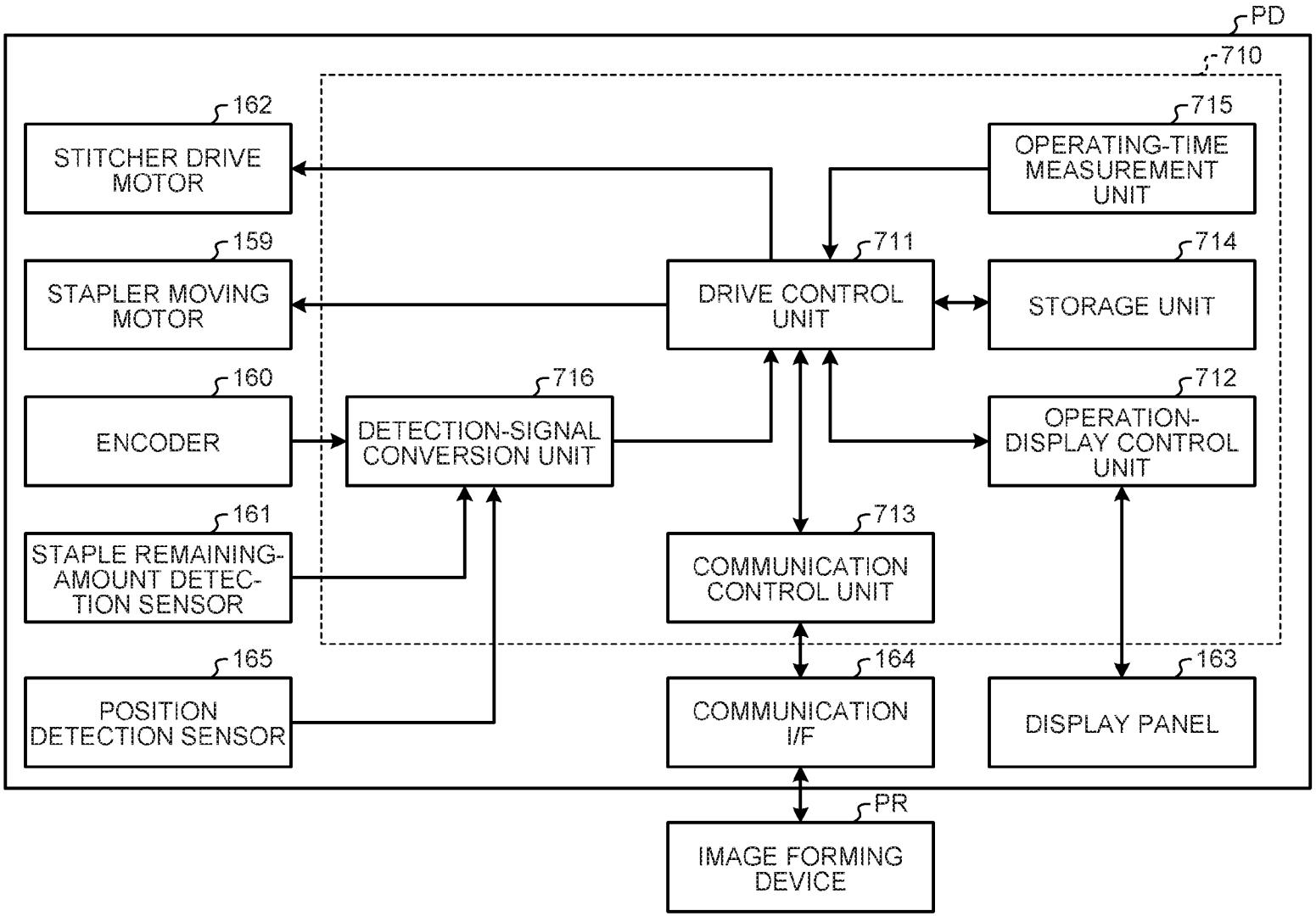
FIG. 27 is a block diagram that schematically illustrates a functional configuration of the post-processing device according to the embodiment.

Next, with reference to FIG. 27, an explanation is given of a functional configuration of the post-processing device PD according to the present embodiment. FIG. 27 is a block diagram that schematically illustrates a functional configuration of the post-processing device PD according to the present embodiment.

As illustrated in FIG. 27, the post-processing device PD according to the present embodiment includes a position detection sensor 165 in addition to the configuration of the first embodiment, and it is capable of measuring the position of the end-face stitching stapler S1 by using the position detection sensor 165.

Figure 28:
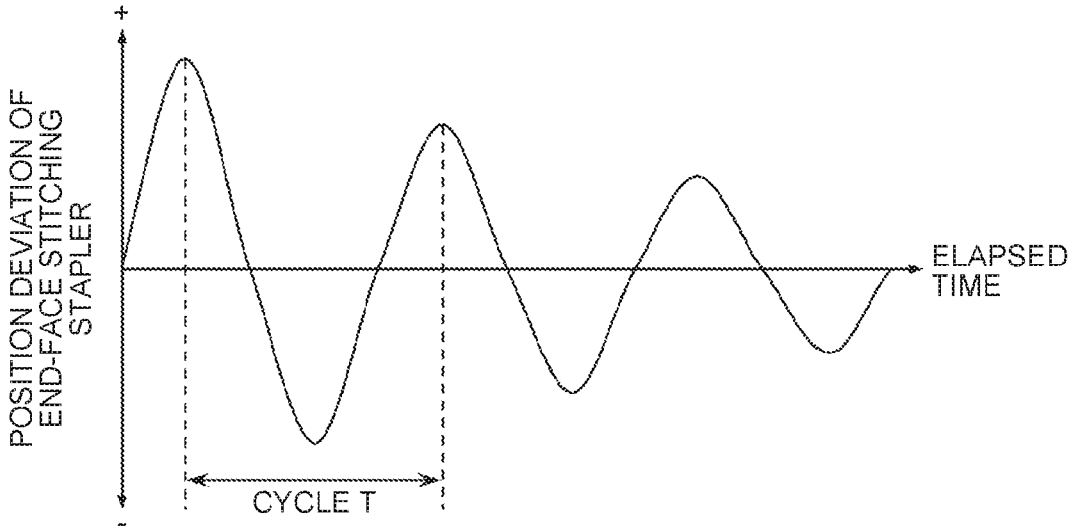
FIG. 28 is a graph that illustrates a method for calculating the natural vibration frequency by the post-processing device according to the embodiment.

Next, with reference to FIG. 28, an explanation is given of a method for calculating the natural vibration frequency by the post-processing device PD according to the present embodiment. FIG. 28 is a graph that illustrates a method for calculating the natural vibration frequency by the post-processing device PD according to the present embodiment.

In the post-processing device PD according to the present embodiment, when the end-face stitching stapler S1 is moved, periodic position deviation occurs in the end-face stitching stapler S1, as illustrated in FIG. 28.

Furthermore, the drive control unit 711 acquires the positional information on the end-face stitching stapler S1 from the position detection sensor 165, estimates a cycle T of the above-described periodic position deviation from the positional information, and calculates the natural vibration frequency ω by using the cycle T on the basis of $\omega=2\pi/T$. That is, according to the present embodiment, the drive control unit 711 serves as a cycle estimating unit.

Furthermore, the post-processing device PD according to the present embodiment uses the natural vibration frequency ω, which is calculated as above, to perform vibration control on the end-face stitching stapler S1 according to the posicast method, which is explained with reference to FIGS. 13 and 14, or the preshape method, which is explained with reference to FIGS. 15 to 17.

As described above, the post-processing device PD according to the present embodiment is configured to measure the natural vibration frequency, which occurs when the end-face stitching stapler S1 is moved, and perform vibration control on the end-face stitching stapler S1 on the basis of the measured natural vibration frequency. With the above configuration of the post-processing device PD according to the present embodiment, even if the natural vibration frequency of the end-face stitching stapler S1 changes, the natural vibration may be prevented.

Furthermore, in the present embodiment, an explanation is given of the post-processing device PD that is configured to calculate the natural vibration frequency ω from the cycle T and perform vibration control on the end-face stitching stapler S1 on the basis of the natural vibration frequency ω. Furthermore, the post-processing device PD according to the present embodiment may be configured to perform vibration control on the end-face stitching stapler S1 on the basis of the cycle T without calculating the natural vibration frequency ω.

Furthermore, in the present embodiment, an explanation is given of the vibration control for preventing the natural vibration that occurs when the end-face stitching stapler S1 is moved. Furthermore, the vibration control according to the present embodiment is applicable to prevent the natural vibration that occurs when a sheet processing unit, such as the punch unit 100, the jogger fence 53, the saddle-stitching upper jogger fence 250*a*, the saddle-stitching lower jogger fence 250*b*, the saddle-stitching stapler S2, the shift tray 202, or the release claw 52*a*, is moved.

Furthermore, the post-processing device PD according to the present embodiment may be configured to perform the above-described vibration control during an initialization operation when the power source is turned on or after the door is opened and closed.

Third Embodiment

Next, an explanation is given of an example of the control for moving a jogger fence in the above-described configuration of the sheet processing device.

Figure 29:
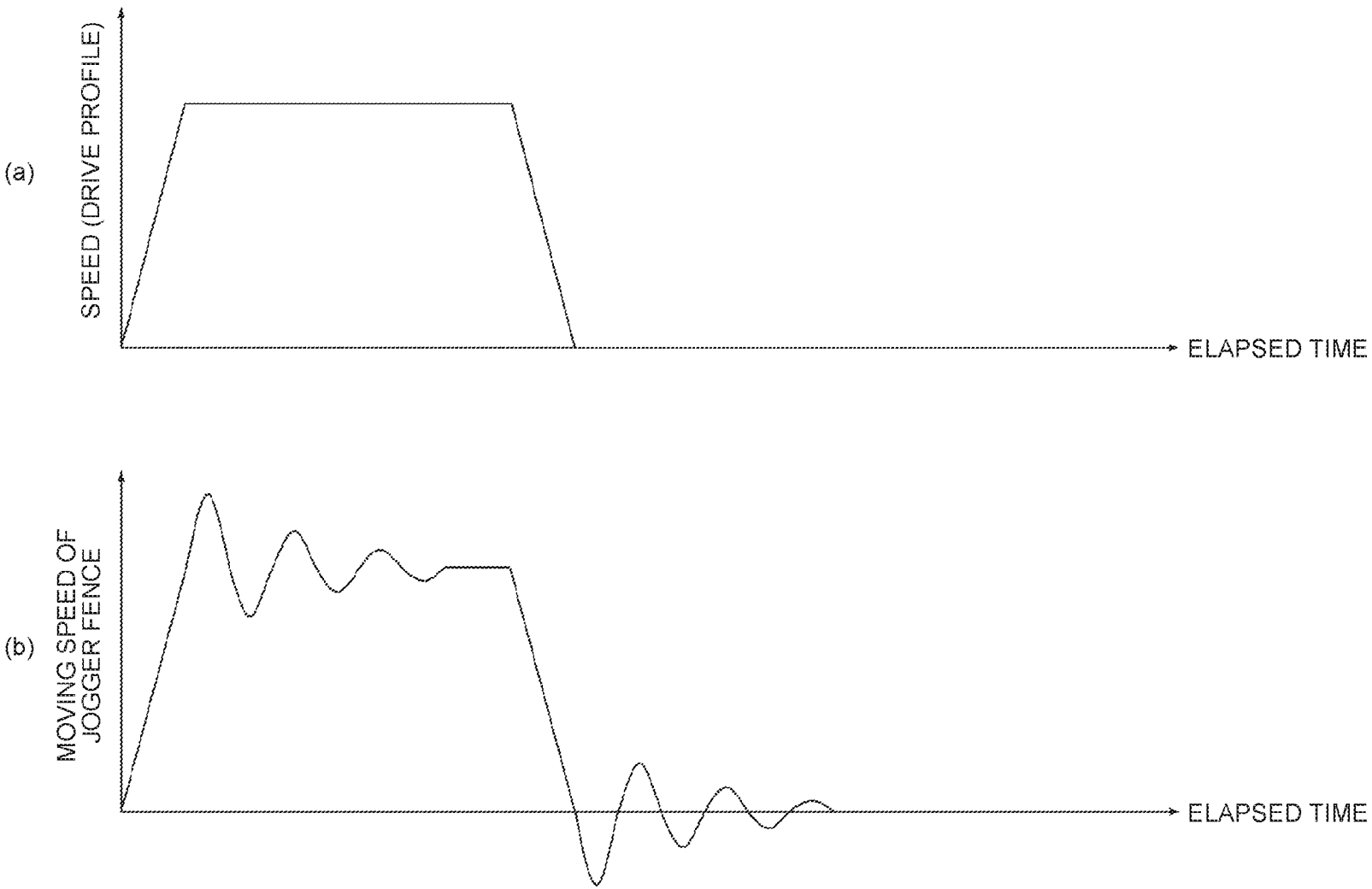
FIG. 29 illustrates the drive profile of a jogger motor and the speed variation of a jogger fence when the conventional sheet processing device moves the jogger fence.

First, with reference to FIG. 29, an explanation is given of the drive profile of a jogger motor and the speed variation of a jogger fence when a conventional sheet processing device moves the jogger fence. In FIG. 29, (a) is a graph that illustrates the drive profile of the jogger motor when the conventional sheet processing device moves the jogger fence. In FIG. 29, (b) is a graph that illustrates the speed variation of the jogger fence when the conventional sheet processing device moves the jogger fence.

When the conventional sheet processing device moves the jogger fence, the drive control unit drives the jogger motor in accordance with the drive profile that is illustrated in (a) in FIG. 29.

However, here, as illustrated in (b) in FIG. 29, in the jogger fence, when the jogger motor is completely started up and when it is stopped, i.e., when acceleration is terminated, speed variation occurs, and the periodic natural vibration is generated. This is because, if the mass of the jogger fence is M, the force F=Ma acts on the jogger fence during acceleration in a moving direction.

Due to this force, the periodic natural vibration occurs in the jogger fence when it is completely started up and when it is stopped, i.e., when acceleration is terminated. Furthermore, due to the occurrence of the periodic natural vibration, noise is generated when a bundle of sheets is aligned, the stop time during alignment is increased, or the alignment accuracy is degraded.

Therefore, when the sheet processing device moves the jogger fence, the drive control unit generates a drive profile to prevent the natural vibration of the jogger fence and drives the jogger motor in accordance with the generated drive profile.

Figure 30:
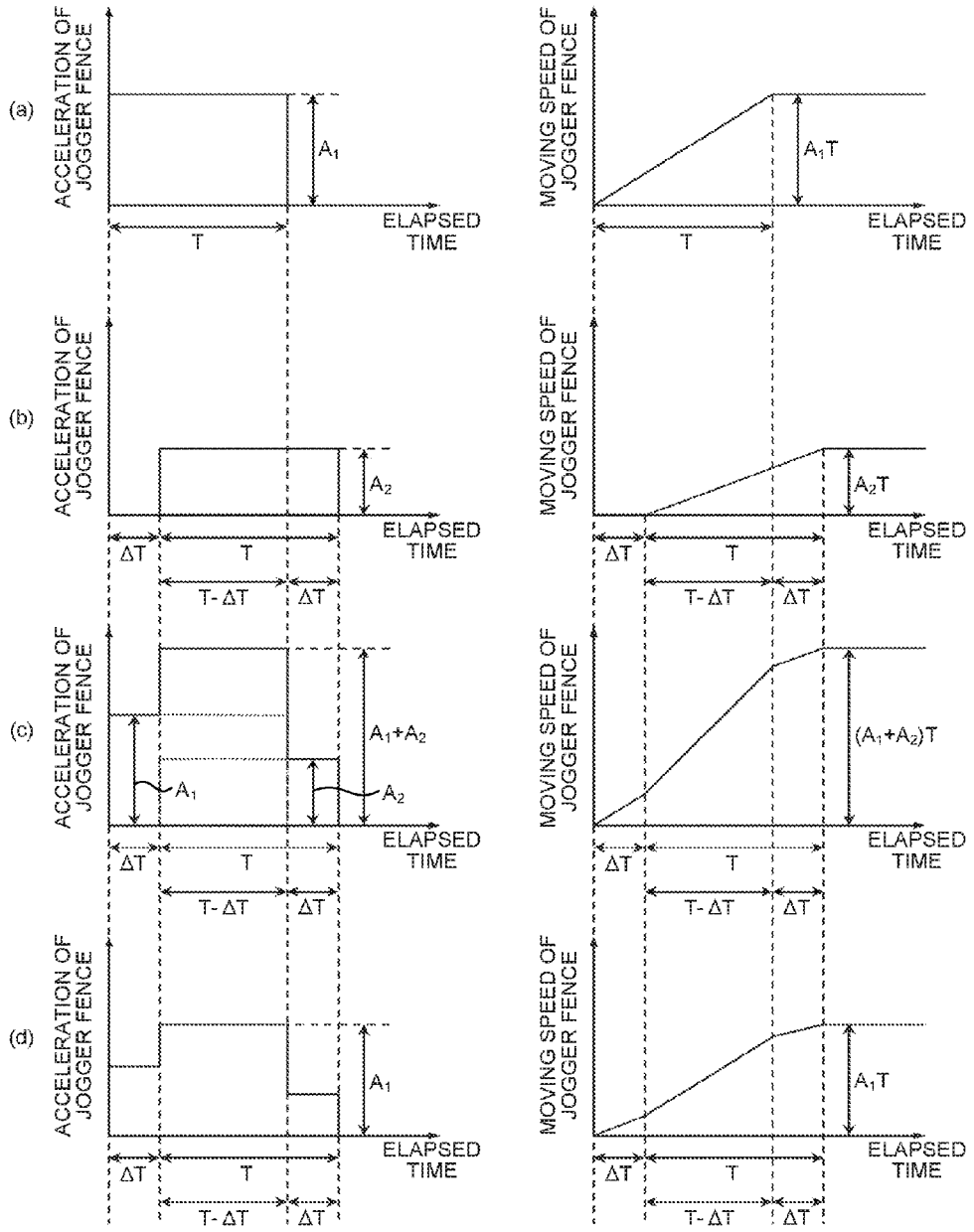
FIG. 30 illustrates the procedure for generating the drive profile of the jogger motor by a sheet processing device.
Figure 31:
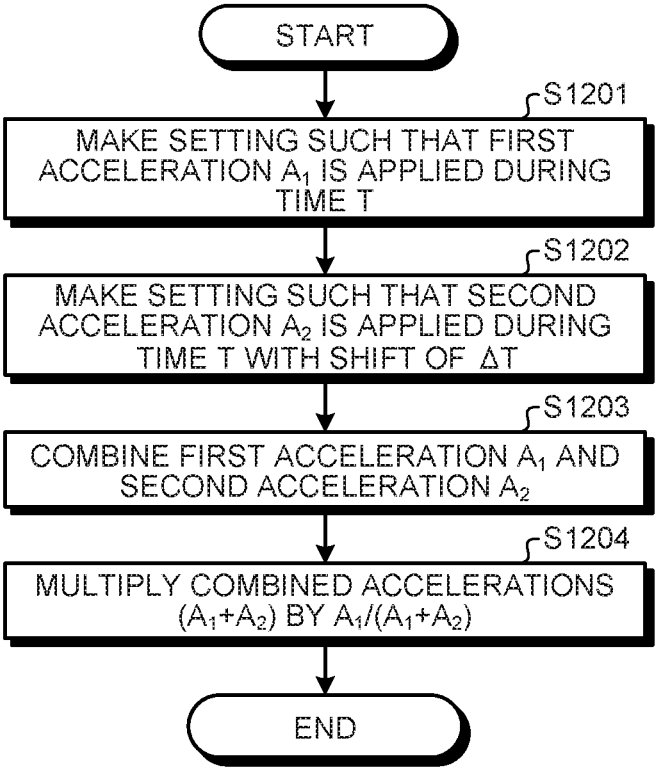
FIG. 31 is a flowchart that illustrates the procedure for generating the drive profile of the jogger motor by the sheet processing device.

Here, an explanation is given, with reference to FIGS. 30 and 31, of the procedure for generating the drive profile of the jogger motor 158 to prevent the natural vibration of the jogger fence 53 when the post-processing device PD moves the jogger fence 53.

FIG. 30 illustrates the procedure for generating the drive profile of the jogger motor 158 by the post-processing device PD. FIG. 31 is a flowchart that illustrates the procedure for generating the drive profile of the jogger motor by the post-processing device PD.

As illustrated in FIGS. 30 and 31, to prevent the natural vibration of the jogger fence 53 by the post-processing device PD, the drive control unit 711 generates the drive profile, with which accelerations are applied to the jogger fence 53 in two steps so that the natural vibration that occurs during the acceleration in the first step is canceled by the natural vibration that occurs during the acceleration in the second step. Furthermore, the post-processing device PD drives the jogger motor 158 in accordance with the drive profile that is generated as described above.

Figure 32:
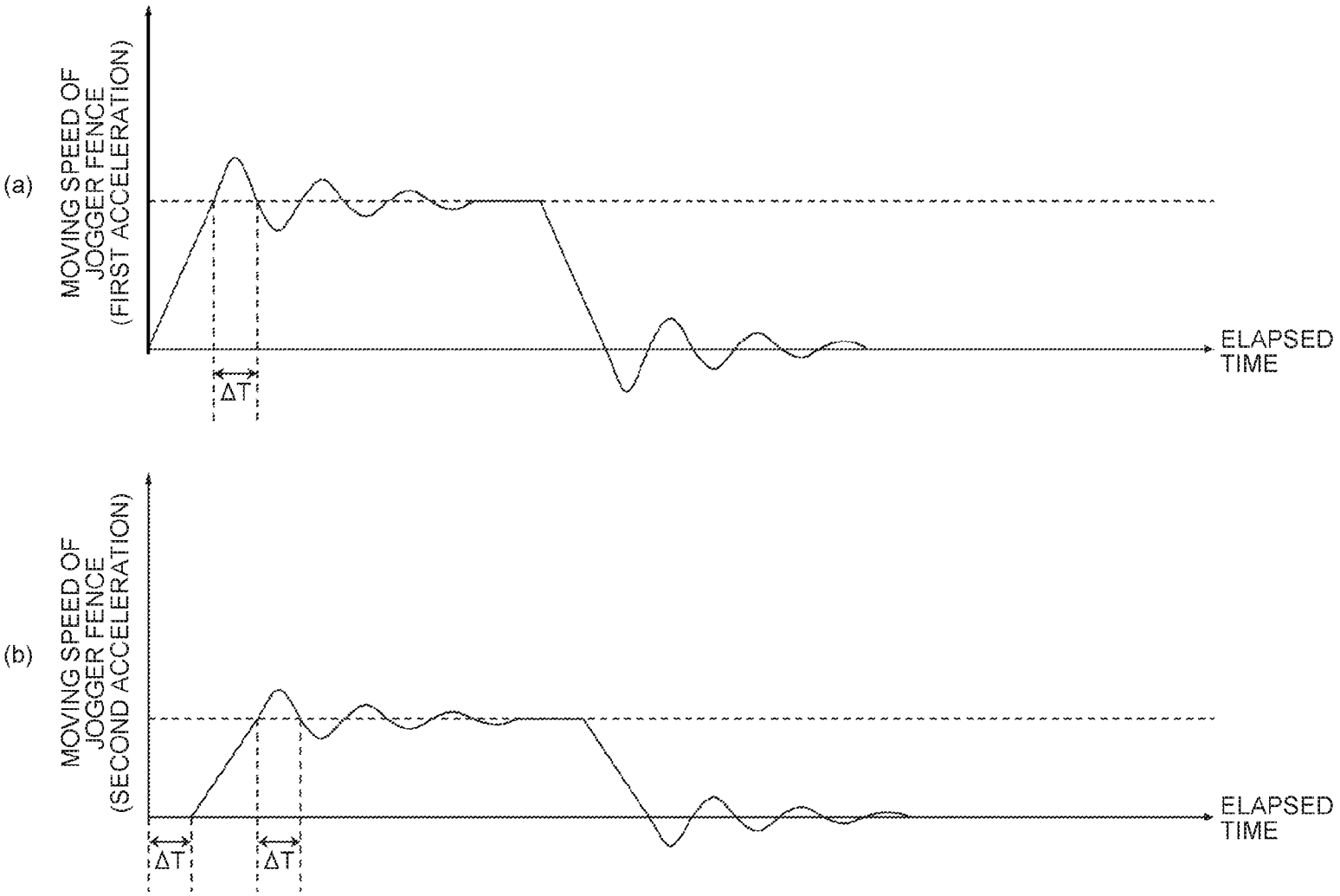
FIG. 32 illustrates the speed variations of the jogger fence when the sheet processing device moves the jogger fence.

Specifically, as illustrated in (a) in FIG. 30, when the post-processing device PD generates the drive profile of the jogger motor 158, the drive control unit 711 first makes the setting such that acceleration (hereafter, referred to as the "first acceleration") $A_1$ in the first step is applied to the jogger fence 53 during the time T at the start of acceleration of the jogger fence 53 (S1201). In FIG. 32, (a) illustrates the speed variations of the jogger fence 53 in the above step.

Furthermore, as illustrated in (b) in FIG. 30, the drive control unit 711 makes the setting such that acceleration (hereafter, referred to as the "second acceleration") $A_2$ in the second step is applied to the jogger fence 53 during the time T with a time shift of the half cycle (ΔT) of the frequency of the natural vibration that occurs due to the first acceleration from the acceleration start time using the first acceleration (S1202). In FIG. 32, (b) illustrates the speed variations of the jogger fence 53 in the above step.

Afterward, as illustrated in (c) in FIG. 30, the drive control unit 711 combines the first acceleration $A_1$ and the second acceleration $A_2$, which are set as described above (S1203). At this point, as the state is such that the drive control unit 711 simply combines the first acceleration $A_1$ and the second acceleration $A_2$, the state is obtained such that the speed at the end of the acceleration is the multiple of the supposed speed $A_1T$ by $(A_1+A_2)/A_1$, as illustrated in (c) in FIG. 30.

Figure 33:
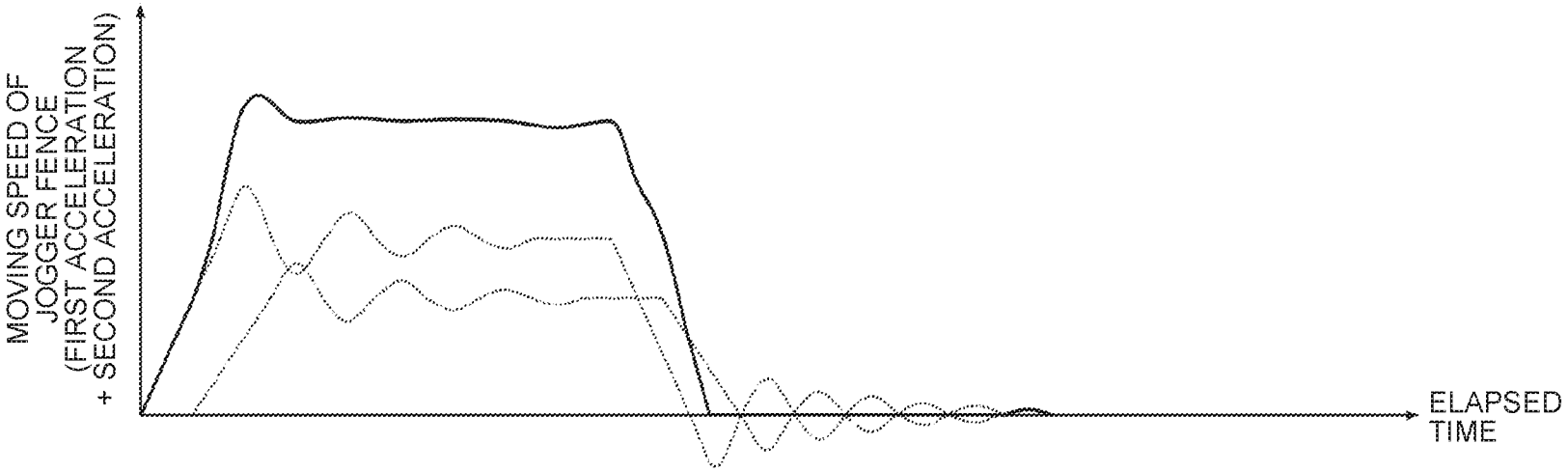
FIG. 33 is a graph that illustrates the speed variation of the jogger fence when the sheet processing device moves the jogger fence.

Therefore, as illustrated in (d) in FIG. 30, to match the speed at the end of acceleration with the supposed speed $A_1T$, the drive control unit 711 multiplies combination acceleration $A_1+A_2$, which is the combination of the acceleration $A_1$ and the acceleration $A_2$, by $A_1/(A_1+A_2)$ (S1204). Thus, the speed at the end of acceleration becomes the same speed as the supposed speed $A_1T$. FIG. 33 illustrates the speed variation of the jogger fence 53 in the above step.

As described above, the post-processing device PD applies the second acceleration with a time shift of the half cycle of the frequency of the natural vibration from the acceleration start time using the first acceleration to generate the natural vibration that has the phase opposite to that of the natural vibration due to the first acceleration, thereby preventing the natural vibration.

As the post-processing device PD drives the jogger motor 158 in accordance with the drive profile, which is generated as described above, it is possible to prevent the natural vibration of the jogger fence 53, compared to the case where the jogger motor 158 is driven by using the drive profile that is illustrated in (a) in FIG. 29, as seen from the comparison between (b) in FIG. 29 and FIG. 33.

Figure 34:
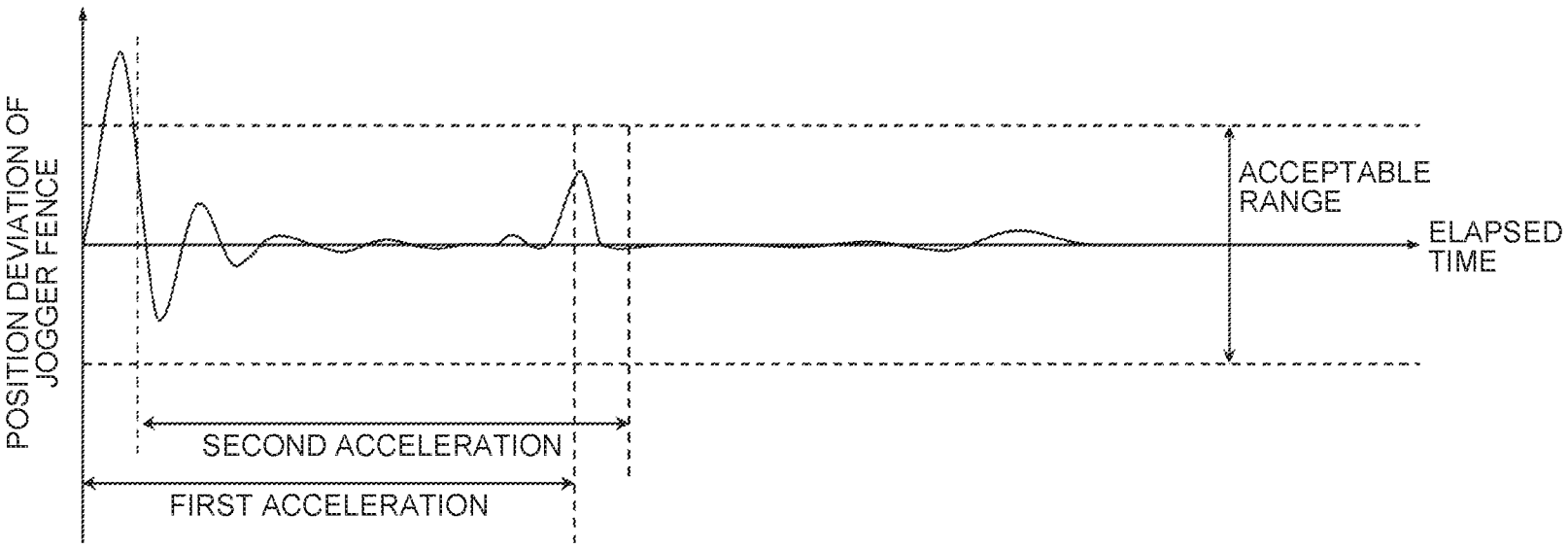
FIG. 34 is a graph that illustrates the position deviation of the jogger fence in the sheet processing device.

However, in the sheet processing device, the natural vibration occurs due to the first acceleration until the second acceleration is applied; therefore, as illustrated in FIG. 34, position deviation occurs in the jogger fence 53, and the position deviation sometimes exceeds the acceptable range.

Figure 35:
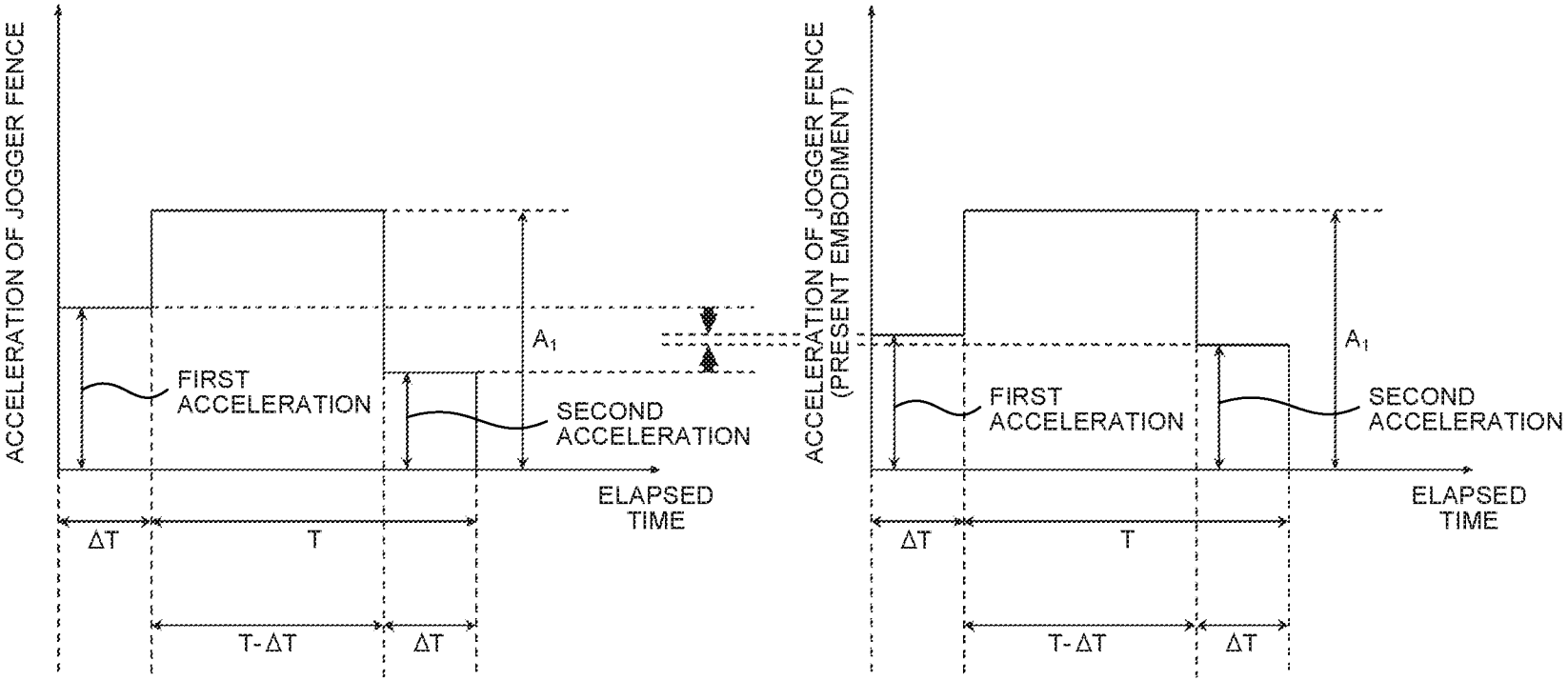
FIG. 35 is a diagram that illustrates a method for generating a drive profile by a sheet processing device according to an embodiment.
Figure 36:
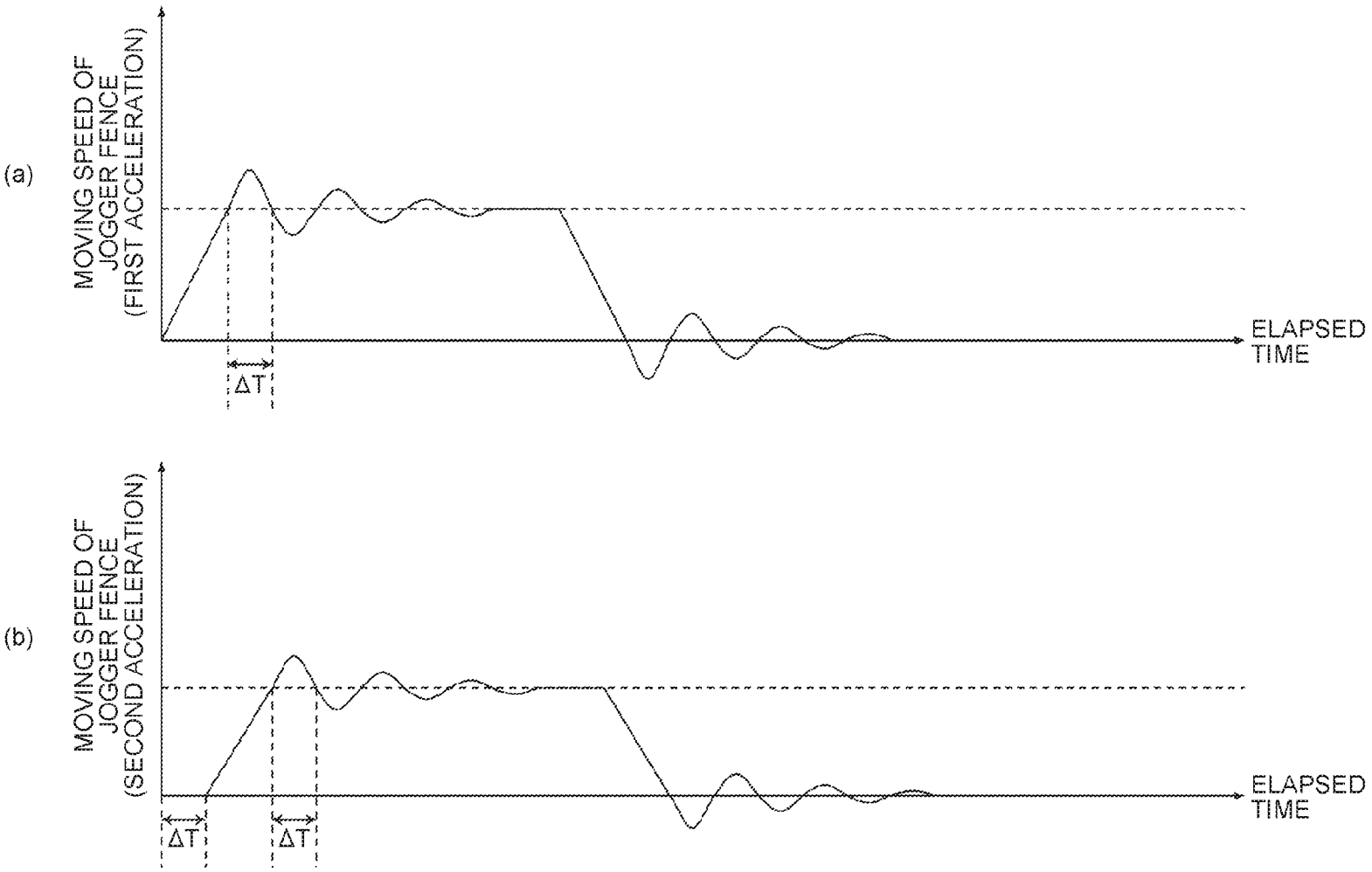
FIG. 36 illustrates the speed variations of the jogger fence when the sheet processing device according to the embodiment moves the jogger fence.
Figure 37:
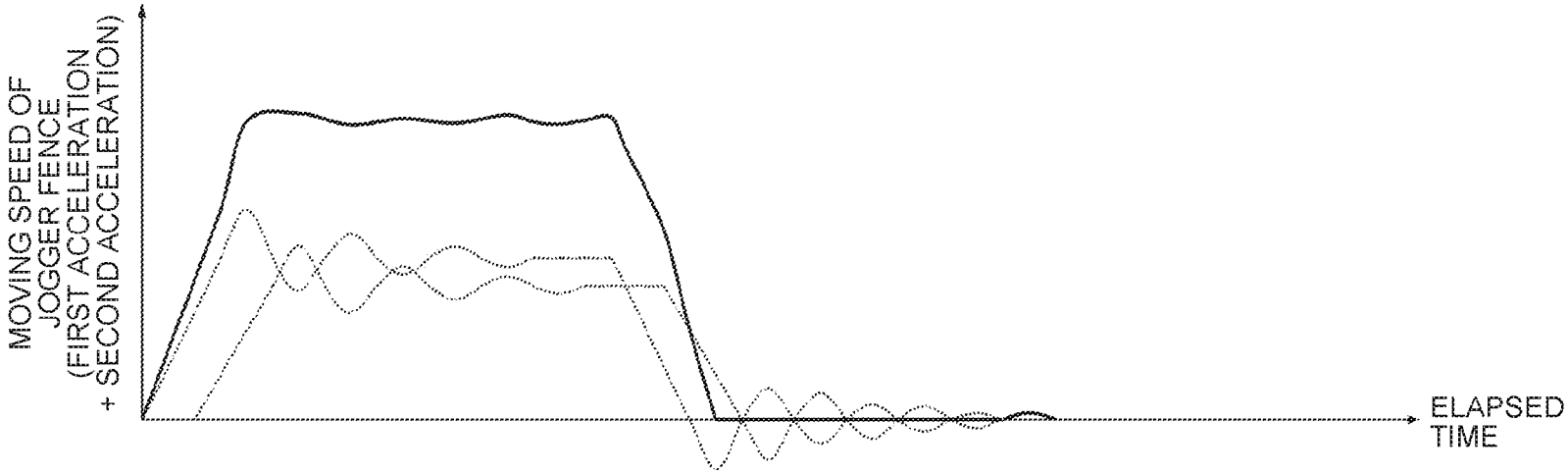
FIG. 37 illustrates the speed variations of the jogger fence when the sheet processing device according to the embodiment moves the jogger fence.
Figure 38:
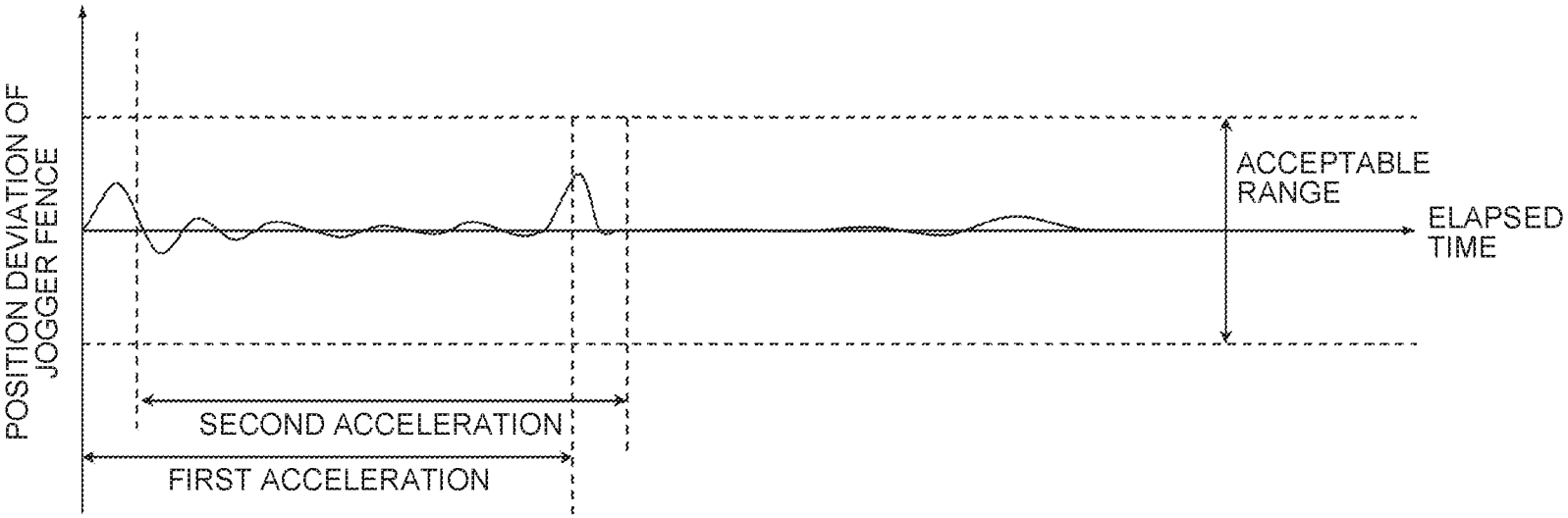
FIG. 38 illustrates the position deviation of the jogger fence in the sheet processing device according to the embodiment.

Therefore, as illustrated in FIG. 35, the post-processing device PD according to the present embodiment is configured to set the level of the first acceleration such that the position deviation of the jogger fence 53 falls within the acceptable range until the second acceleration is applied. FIGS. 36 and 37 illustrate the speed variations of the jogger fence 53 at this point, and FIG. 38 illustrates the position deviation of the jogger fence 53.

Thus, the post-processing device PD according to the present embodiment may improve the alignment accuracy without decreasing the productivity. Furthermore, the post-processing device PD according to the present embodiment may prevent noise, which occurs when a bundle of sheets is aligned, or may shorten the stop time during alignment. Moreover, the post-processing device PD according to the present embodiment may prevent the cut surface of the sheet bundle from being contaminated or prevent it from being damaged.

At this point, the drive control unit 711 generates the drive profile as the drive mode of the jogger motor 158. That is, according to the present embodiment, the drive control unit 711 serves as a drive-mode determining unit.

Furthermore, here, the setting for the acceptable range is made when it is input from the image forming device PR to the drive control unit 711, when it is automatically detected by the drive control unit 711, or when it is input to the drive control unit 711 in accordance with a user's operation on a display panel 720. That is, according to the present embodiment, the drive control unit 711 serves as an acceptable-range setting unit.

Furthermore, the post-processing device PD according to the present embodiment may be configured to drive the jogger motor 158 by using the usual drive profile, which is illustrated in (a) in FIG. 29, during other than the alignment operation, e.g., when the jogger fence 53 is moved to the home position or during the operation to retract it. That is, the post-processing device PD according to the present embodiment may be configured to set the level of the first acceleration such that the position deviation of the jogger fence 53 falls within the acceptable range until the second acceleration is applied only during the alignment operation of the jogger fence 53.

This is because the natural vibration does not need to be prevented other than during the alignment operation and the jogger fence 53 is moved in a short time as much as possible so that the productivity is improved.

Figure 39:
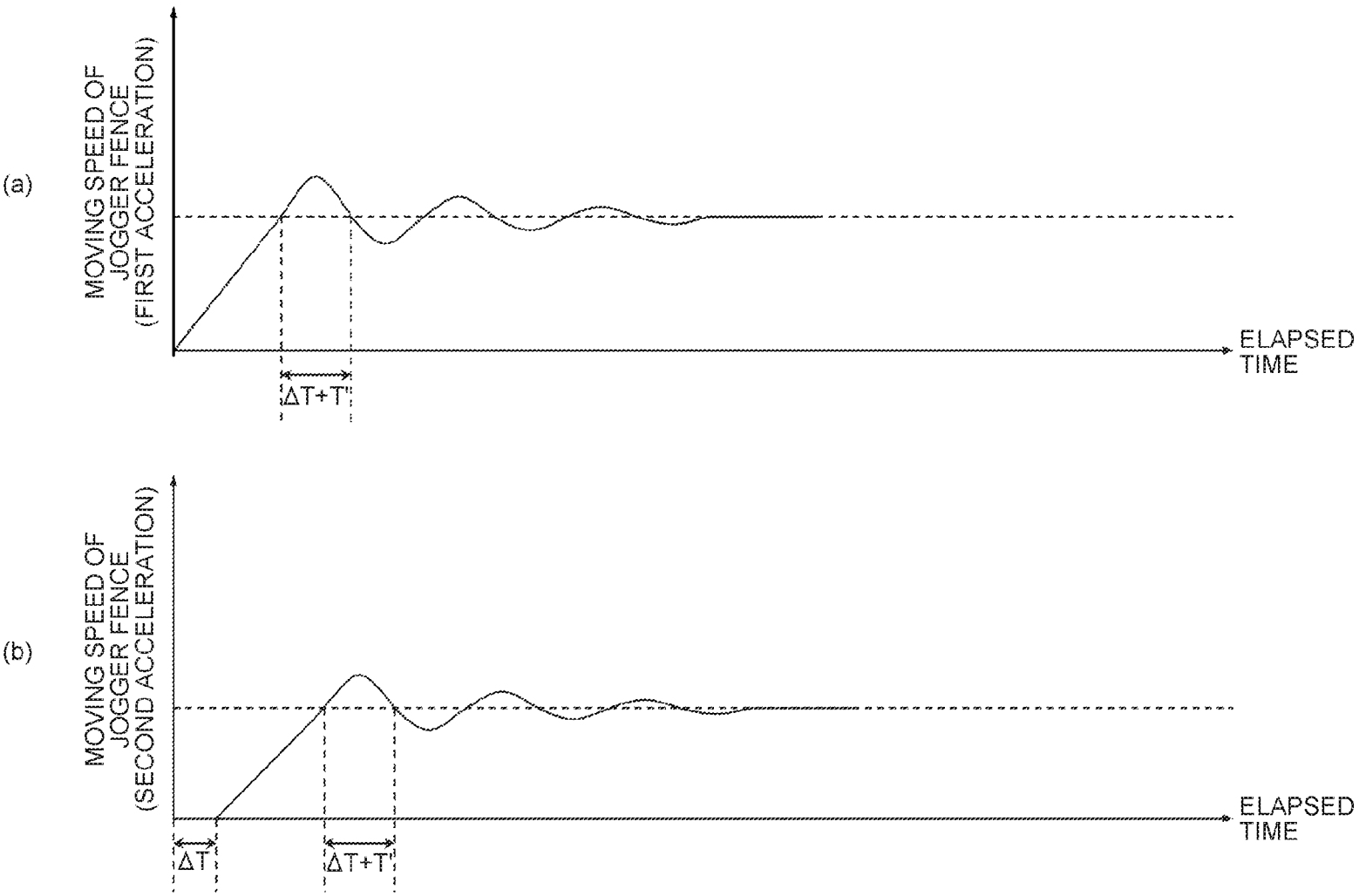
FIG. 39 illustrates the speed variations of the jogger fence when the sheet processing device according to the embodiment moves the jogger fence.

Furthermore, the cycle of the natural vibration of the jogger fence 53 sometimes changes in accordance with the usage state, such as the attachment way or the attachment position of the jogger fence 53 or the jogger motor 158, time degradation, or characteristic change, as illustrated in FIG. 39. Hereinafter, the half cycle of the frequency of the natural vibration before a change is made is referred to as $\Delta T$, and the half cycle of the frequency of the natural vibration after a change is made as $\Delta T+T'$.

Figure 40:
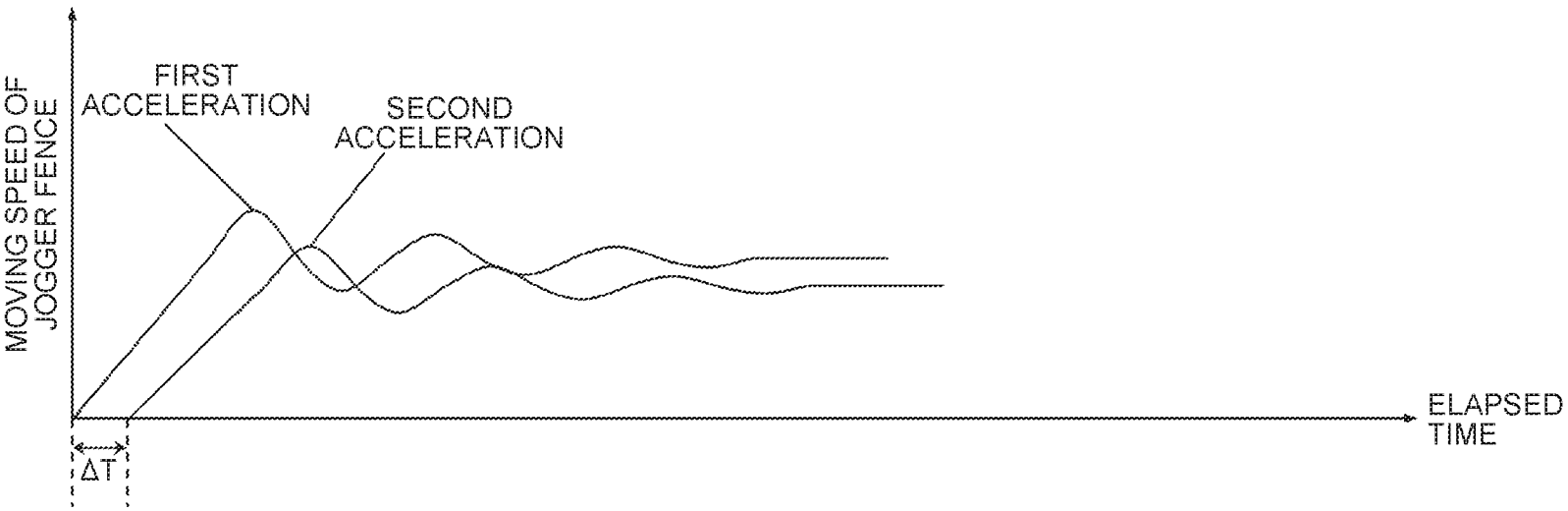
FIG. 40 illustrates the speed variations of the jogger fence when the sheet processing device according to the embodiment moves the jogger fence.

In such a case, if the post-processing device PD according to the present embodiment applies the second acceleration with a time shift of $\Delta T$ from the acceleration start using the first acceleration, the natural vibration due to the second acceleration does not have the phase opposite to that of the natural vibration due to the first acceleration. Therefore, in this case, in the post-processing device PD according to the present embodiment, the natural vibration due to the first acceleration may not be canceled by the natural vibration due to the second acceleration, as illustrated in FIG. 40, and the natural vibration may not be prevented.

Figure 41:
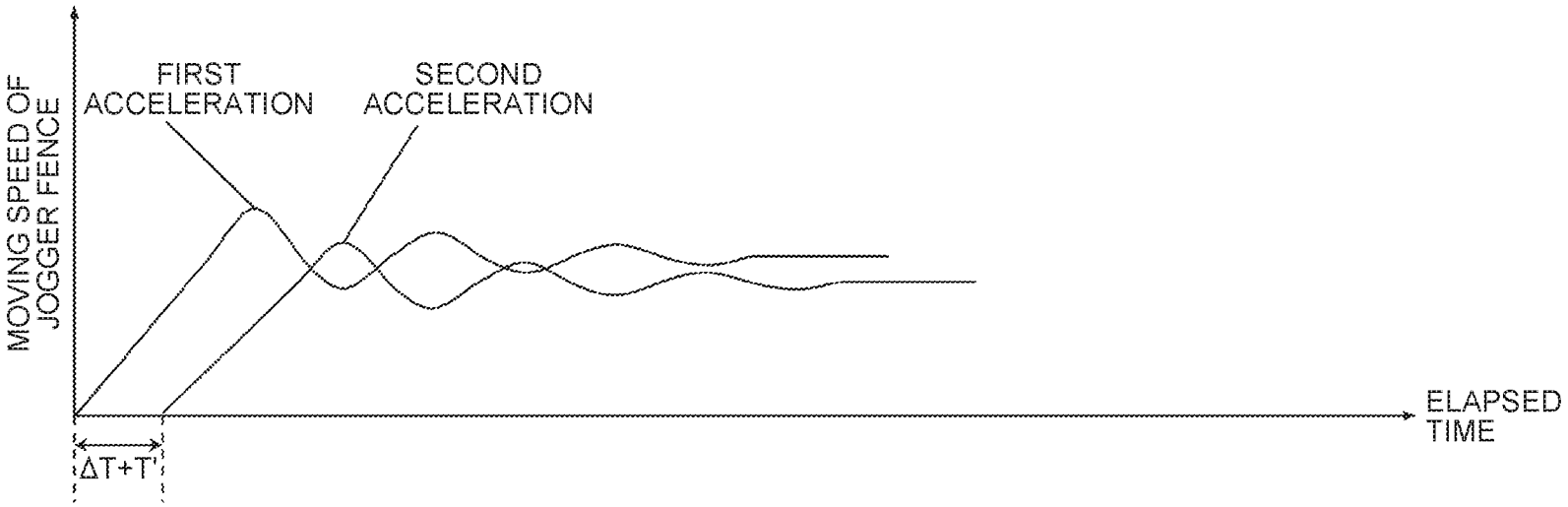
FIG. 41 illustrates the speed variations of the jogger fence when the sheet processing device according to the embodiment moves the jogger fence.

Therefore, the post-processing device PD according to the present embodiment is configured to apply the second acceleration to the jogger fence 53 with a time shift of $\Delta T+T'$ from the acceleration start using the first acceleration, as illustrated in FIG. 41. With this configuration of the post-processing device PD according to the present embodiment, even if the cycle of the natural vibration of the jogger fence 53 changes, the natural vibration due to the second acceleration may have the phase opposite to that of the natural vibration due to the first acceleration.

Therefore, the post-processing device PD according to the present embodiment may prevent the natural vibration even if the cycle of the natural vibration of the jogger fence 53 changes.

Here, the setting for T' is automatically made by the drive control unit 711, or it is made when it is input in accordance with a user's operation on the display panel 720.

Furthermore, as the post-processing device PD according to the present embodiment sets the first acceleration such that the position deviation of the jogger fence 53 falls within the acceptable range; therefore, to improve the productivity, the second acceleration needs to be increased as the first acceleration is decreased. Therefore, the post-processing device PD according to the present embodiment may be configured to set both the first acceleration and the second acceleration so as to achieve both an improvement in the productivity and an improvement in the alignment accuracy.

Furthermore, the post-processing device PD according to the present embodiment may be configured to set the acceptable range of the position deviation of the jogger fence 53 in accordance with the number of sheets to be aligned. For example, the post-processing device PD according to the present embodiment sets the narrow acceptable range if the number of sheets to be aligned is small and sets the wide acceptable range if the number of sheets to be aligned is large. With this configuration of the post-processing device PD according to the present embodiment, it is possible to improve the alignment accuracy.

Furthermore, the post-processing device PD according to the present embodiment may be configured to set the acceptable range of the position deviation of the jogger fence 53 in accordance with sheet information, such as the type of sheet, which is the target to be aligned, or the thickness of a sheet. With this configuration of the post-processing device PD according to the present embodiment, it is possible to improve the alignment accuracy.

Here, the number of sheets to be aligned and the sheet information are input from the image forming device PR, are automatically detected by the drive control unit 711, or are input in accordance with a user's operation on the display panel 720.

As described above, the post-processing device PD according to the present embodiment is configured to set the level of the first acceleration such that the position deviation of the jogger fence 53 falls within the acceptable range until the second acceleration is applied. Therefore, the post-processing device PD according to the present embodiment may improve the alignment accuracy without decreasing the productivity.

Furthermore, the post-processing device PD according to the present embodiment may prevent noise, which occurs when a bundle of sheets is aligned, or may shorten the stop time during alignment. Moreover, the post-processing device PD according to the present embodiment may prevent the cut surface of the sheet bundle from being contaminated or prevent it from being damaged.

Furthermore, in the present embodiment, an explanation is given of the jogger fence 53 as an alignment mechanism for alignment in a sheet width direction. Furthermore, the configuration according to the present embodiment is applicable for pressing the trailing edge of the sheet bundle, which is housed in the trailing-edge reference fence 51, from the sheet surface by using the trailing-edge pressing lever 110, for alignment in a sheet conveying direction and in a sheet thickness direction by using the tapping roller 12, or for alignment in a sheet conveying direction by using the release claw 52*a*. With this configuration of the post-processing device PD, the tapping roller 12, the release claw 52*a*, the jogger fence 53, and the trailing-edge pressing lever 110 serve as an aligning unit.

According to the embodiment, it is possible to prevent vibration that occurs when a sheet processing unit is moved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing device comprising:

a sheet processing device configured to move so to perform sheet processing on a sheet;

a sheet-processing moving device configured to move the sheet processing device;

a processor configured to determine, via a drive-mode determining unit, a drive mode of the sheet-processing moving device; and a drive control device configured to drive the sheet-processing moving device in accordance with the drive mode, wherein the processor is configured to determine the drive mode such that the sheet processing device is moved at a combined acceleration which is a combination of a first acceleration and a second acceleration with a shift of time that is an addition of time of a half cycle of a natural vibration and a time of an integral multiple of the cycle of the natural vibration.

2. The sheet processing device according to claim 1, wherein the processor is configured to determine the cycle in accordance with a usage condition of at least one of the sheet processing device and the sheet-processing moving device.

3. The sheet processing device according to claim 2, wherein the usage condition is at least one of a weight, an operating time, a number of times a move is made, and a moving distance of the sheet processing device.

4. The sheet processing device according to claim 1, wherein the processor is configured to determine the cycle in accordance with a frequency and an attenuation rate of the natural vibration.

5. The sheet processing device according to claim 1, wherein the processor is configured to determine a level of the second acceleration in accordance with an attenuation rate of the natural vibration.

6. The sheet processing device according to claim 1, further comprising a drive-mode setting device configured to make a setting as to whether to move the sheet processing device in a drive mode that is determined such that the sheet processing device is moved at the combined acceleration or in a preset drive mode.

7. The sheet processing device according to claim 1, further comprising:

a positional-information acquiring device configured to acquire positional information on the sheet processing device; and a cycle estimating device configured to estimate the cycle based on the acquired positional information, wherein the drive-mode determining unit is configured to determine the drive mode based on the estimated cycle.

8. The sheet processing device according to claim 7, wherein the positional-information acquiring device, the cycle estimating device, and the drive-mode determining unit are configured to acquire the positional information, estimate the cycle, and determine the drive mode, respectively, in an initialization operation that is performed when a power source is turned on or after a door is opened and closed.

9. The sheet processing device according to claim 7, wherein the positional-information acquiring device is at least one of an optical rotary encoder and a linear scale.

10. The sheet processing device according to claim 1, wherein the sheet processing device is at least one of a stitching processing device configured to stitch a bundle of sheets, a sheet ejecting device configured to eject a bundle of sheets, a sheet aligning device configured to align a bundle of sheets, and a sheet stacking device on which a bundle of sheets is stacked.

11. The sheet processing device according to claim 10, wherein the sheet ejecting device is a release claw, the sheet aligning device is a jogger fence, and the sheet stacking device is a shift tray.

12. An image forming system comprising:

the sheet processing device according to claim 1; and an image forming device that forms an image on the sheet.

13. A non-transitory computer-readable storage medium with an executable program stored thereon and executed by a computer, wherein the program instructs the computer to perform:

determining a drive mode of a sheet-processing moving device that moves a sheet processing device to perform sheet processing on a sheet such that the sheet processing device is moved at a combined acceleration that is a combination of a first acceleration and a second acceleration with a shift of time that is an addition of time of a half cycle of a natural vibration and a time of an integral multiple of the cycle of the natural vibration; and driving the sheet-processing moving device in accordance with the drive mode.

14. A sheet processing device that aligns a sheet to be stacked, comprising:

a sheet stacking device on which a conveyed sheet is stacked;

an aligning device configured to move relative to the sheet stacked on the sheet stacking device to align the sheet stacked on the sheet stacking device;

a moving device configured to move the aligning device relative to the sheet stacked on the sheet stacking device; and a processor configured to:

determine a level of first acceleration at start of acceleration of the moving device such that position deviation that occurs in the aligning device due to natural vibration generated in the aligning device during acceleration of the moving device falls within a preset acceptable range, and determine, as a drive mode of the moving device, a combined acceleration that is a combination of the first acceleration and second acceleration with a delay of time of a half cycle of the natural vibration from acceleration start time of the moving device due to the first acceleration; and a drive control device configured to control driving of the moving device in accordance with the determined drive mode.

* * * * *